US008998595B2

(12) United States Patent
Ito et al.

(10) Patent No.: US 8,998,595 B2
(45) Date of Patent: Apr. 7, 2015

(54) SCROLL COMPRESSOR WITH PASSAGE IN THE SPIRAL WRAP

(75) Inventors: Tatsuya Ito, Kariya (JP); Yoshikazu Fukutani, Kariya (JP); Ken Suitou, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 971 days.

(21) Appl. No.: 13/132,815

(22) PCT Filed: Nov. 17, 2009

(86) PCT No.: PCT/JP2009/069477

§ 371 (c)(1),
(2), (4) Date: Jun. 3, 2011

(87) PCT Pub. No.: WO2010/064537

PCT Pub. Date: Jun. 10, 2010

(65) Prior Publication Data

US 2011/0243777 A1 Oct. 6, 2011

(30) Foreign Application Priority Data

Dec. 3, 2008 (JP) ..... 2008-308862
Aug. 19, 2009 (JP) ..... 2009-190424
Oct. 5, 2009 (JP) ..... 2009-231083

(51) Int. Cl.
*F04C 18/02* (2006.01)
*F04C 29/00* (2006.01)
(Continued)

(52) U.S. Cl.
CPC ..... *F04C 18/0215* (2013.01); *F04C 18/0284* (2013.01); *F04C 18/0292* (2013.01);
(Continued)

(58) Field of Classification Search
USPC ..... 418/55.5, 55.2
See application file for complete search history.

(56) References Cited

U.S. PATENT DOCUMENTS 4,357,132 A * 11/1982 Kousokabe ..... 418/55.5
5,762,483 A 6/1998 Lifson et al.
(Continued)

FOREIGN PATENT DOCUMENTS

CN 1807892 A 7/2006
JP 6-213175 A 8/1994
(Continued)

OTHER PUBLICATIONS

Office Action for corresponding Chinese Patent Application No. CN 200980156123.1 issued on Jul. 19, 2013.
(Continued)

*Primary Examiner* — Mary A Davis
(74) *Attorney, Agent, or Firm* — Sughrue Mion, PLLC

(57) ABSTRACT

[Object] To provide a scroll compressor capable of improving compression efficiency.
[Means of Solution]
In a scroll compressor 1, a fixed scroll 16 includes a fixed base plate 16*c*, and a fixed spiral wrap 16*d* integral with the fixed base plate 16*c*, while a movable scroll 22 includes a movable base plate 22*a* facing to the fixed base plate 16*c* and a movable spiral wrap 22*b* integral with the movable base plate 22*a* and meshing with the fixed spiral wrap 16*d*. The movable scroll 22 is formed with a supply passage 50, which is formed by an inflow opening 51 opened to a distal end face 22*f* of the movable spiral wrap 22*b* and communicatable with compression chamber 38, an outflow opening 52 formed in the movable base plate 22*a* to communicate with a back pressure chamber 39, and a communication hole 53 communicating the inflow opening 51 with the outflow opening 52, so as to communicate the compression chamber 38 with the back pressure chamber 39 by an elastic deformation or displacement in a direction of the orbit axis R of the movable scroll 22.

14 Claims, 20 Drawing Sheets

(51) Int. Cl.

| | |
|---|---|
| ***F04C 27/00*** | (2006.01) |
| ***F04C 29/02*** | (2006.01) |
| *F04C 23/00* | (2006.01) |

(52) U.S. Cl.

CPC ..... *F04C23/008* (2013.01); *F04C 27/005* (2013.01); *F04C 29/0021* (2013.01); *F04C 29/028* (2013.01)

(56) References Cited

U.S. PATENT DOCUMENTS

| | | | | |
|---|---|---|---|---|
| 6,318,982 | B1 | 11/2001 | Fujii et al. | |
| 6,517,332 | B1 | 2/2003 | Lifson et al. | |
| 7,229,261 | B2 * | 6/2007 | Morimoto et al. | 418/55.5 |
| 8,226,387 | B2 * | 7/2012 | Ignatiev | 418/55.5 |
| 2006/0153725 | A1 | 7/2006 | Koide et al. | |

FOREIGN PATENT DOCUMENTS

| | | | | |
|---|---|---|---|---|
| JP | 06213175 | A | * | 8/1994 |
| JP | 7-189953 | A | | 7/1995 |
| JP | 2005-140016 | A | | 6/2005 |
| JP | 2005140016 | A | * | 6/2005 |
| JP | 2006-220142 | A | | 8/2006 |
| JP | 2006220142 | A | * | 8/2006 |

OTHER PUBLICATIONS

Communication dated Apr. 11, 2014, issued by the State Intellectual Property Office of the People's Republic of China in corresponding Application No. 200980156123.1.

* cited by examiner

SCROLL COMPRESSOR WITH PASSAGE IN THE SPIRAL WRAP

CROSS REFERENCE TO RELATED APPLICATIONS

This application is a National Stage of International Application No. PCT/JP2009/069477, filed on Nov. 17, 2009, which claims priority from Japanese Patent Application Nos. 2008-308862, filed on Dec. 3, 2008, 2009-190424, filed on Aug. 19, 2009 and 2009-231083 filed on Oct. 5, 2009, the contents of all of which are incorporated herein by reference in their entirety.

TECHNICAL FIELD

The present invention relates to a scroll compressor.

BACKGROUND ART

Patent Document 1 discloses a conventional scroll compressor. This scroll compressor includes a housing, a fixed scroll fixed inside the housing and forming a discharge chamber between the fixed scroll and the housing, a movable scroll supported inside the housing such as to orbit only around an orbit axis and forming compression chamber chambers between the movable scroll and the fixed scroll, and a shaft support member fixed inside the housing and forming a back pressure chamber between the shaft support member and the movable scroll.

The fixed scroll includes a fixed base plate and a fixed spiral wrap integral with the fixed base plate. The movable scroll includes a movable base plate facing to the fixed base plate, and a movable spiral wrap integral with the movable base plate and meshing with the fixed spiral wrap. When the movable scroll orbits, the compression chambers defined by the fixed base plate, the fixed spiral wrap, the movable base plate, and the movable spiral wrap move toward the center with a progressively decreasing volume, as a result of which the refrigerant gas inside the compression chambers are compressed. A cylindrical spinning boss is formed on the side of the movable scroll facing the back pressure chamber.

The movable base plate of the movable scroll is formed with a narrow hole for supplying the refrigerant gas inside the compression chambers into the back pressure chamber as the chambers move toward the center. The outer periphery of the movable base plate that is in sliding contact with the outer periphery of the fixed base plate is concavely formed an annular groove. The annular groove communicates with the inside of the spinning boss through a communication hole formed inside the movable scroll.

Between the housing and the shaft support member is formed a motor chamber accommodating an electric motor for driving the movable scroll. The rotating shaft of the electric motor is rotatably supported by the housing and the shaft support member. The discharge chamber and the motor chamber communicate with each other through a through hole formed on an outer circumferential side of the fixed scroll and the shaft support member.

An eccentric portion convexly formed at one end of the rotating shaft of the electric motor rotatably fits in the spinning boss. The rotating shaft is formed with an oil supply hole that communicates the motor chamber with the inside of the spinning boss.

In this scroll compressor, as the movable scroll is driven by the electric motor and orbits, the refrigerant gas is compressed in the compression chamber to a high pressure and discharged to the outside through the discharge chamber and the motor chamber.

Now, in this scroll compressor, during low-load operation, the refrigerant gas at an intermediate pressure inside the compression chamber is supplied to the back pressure chamber through the narrow hole of the movable base plate so as to bias the movable scroll toward the fixed scroll to a suitable extent. In this case, the outer peripheries of the fixed base plate and the movable base plate are in sliding contact with each other, with lubricating oil contained in the refrigerant gas being present therebetween. Oil film of this lubricating oil acts as an oil seal, providing a seal between the annular groove and the back pressure chamber. Therefore a power loss hardly occurs in the orbital motion of the movable scroll, and a refrigerant gas leak is unlikely to occur.

On the other hand, during high-load operation, the movable scroll cannot be biased sufficiently toward the fixed scroll by merely supplying the refrigerant gas at an intermediate pressure in the compression chamber to the back pressure chamber through the narrow hole. In this case, the movable scroll is subjected to a force that causes it to tilt relative to the fixed scroll, i.e., an overturning force. Because of this, the outer peripheries of the fixed base plate and the movable base plate separate from each other, breaking the oil seal that was sealing the annular groove. The annular groove and the back pressure chamber thereby communicate with each other, allowing the refrigerant gas at a discharge pressure inside the motor chamber to be supplied to the back pressure chamber via the oil supply hole, inside of the spinning boss, the communication hole, and the annular groove, so as to raise the pressure inside the back pressure chamber. This scroll compressor is capable of biasing the movable scroll toward the fixed scroll to a suitable extent in this manner even during high-load operation.

PRIOR ART DOCUMENTS

Patent Documents

Patent Document 1: Japanese Laid-Open Patent Application Publication No. 6-213175

SUMMARY OF THE INVENTION

Problems to be Solved by the Invention

In the conventional scroll compressor described above, however, when the oil seal that was sealing the annular groove is broken during high-load operation so that the refrigerant gas at a discharge pressure inside the motor chamber is supplied to the back pressure chamber, there is a possibility that the compression chambers communicate with the back pressure chamber on the outer periphery side of the movable scroll, thereby causing a refrigerant gas leak. This makes it difficult to improve compression efficiency of this scroll compressor.

The present invention was devised in view of the conventional circumstances described above, aiming to provide a scroll compressor capable of improving the compression efficiency.

Means for Solving the Problems

A scroll compressor according to the present invention includes a housing, a fixed scroll fixed inside the housing and forming a discharge chamber between the fixed scroll and the housing, a movable scroll supported inside the housing so as to orbit only around an orbit axis and forming compression chamber between the movable scroll and the fixed scroll, and a shaft support member fixed inside the housing and forming a back pressure chamber between the shaft support member and the movable scroll as well as an suction chamber between the shaft support member and the housing, wherein the fixed scroll includes a fixed base plate and a fixed scroll wrap integral with the fixed base plate;

the movable scroll includes a movable base plate facing to the fixed base plate and a movable spiral wrap integral with the movable base plate and meshing with the fixed spiral wrap; and the movable scroll is formed with a supply passage configured to communicate the compression chamber with the back pressure chamber by an elastic deformation or displacement in a direction of the orbit axis of the movable scroll, the supply passage including an inflow opening opened to a distal end face of the movable spiral wrap and communicatable with the compression chamber, an outflow opening formed in the movable base plate to communicate with the back pressure chamber, and a communication hole communicating with the inflow opening and the outflow opening (Claim 1).

In the scroll compressor according to the present invention, when the back pressure inside the back pressure chamber is at an appropriate level so that the movable scroll is biased toward the fixed scroll to a suitable extent, the fixed base plate is in sliding contact with the distal end face of the movable spiral wrap. The fixed base plate and the distal end face of the movable spiral wrap slide against each other with lubricating oil contained in the refrigerant gas being present therebetween. Therefore, oil film of this lubricating oil acts as an oil seal to provide a seal between the movable spiral wrap and the compression chamber. The oil film of the lubricating oil acts as an oil seal to provide a seal also between the inflow opening opened to the distal end face of the movable spiral wrap and the compression chamber. Therefore a power loss is hard to occur in the orbital motion of the movable scroll, and a refrigerant gas leak is unlikely to occur.

On the other hand, if, at the start-up or during high-load operation or the like, the back pressure in the back pressure chamber is insufficient and the movable scroll cannot be biased sufficiently toward the fixed scroll, then the center side of the movable scroll deforms elastically in a direction away from the fixed scroll, or the movable scroll itself is slightly displaced in the orbit axis direction. Such an elastic deformation or displacement in the orbit axis direction occurs before the movable scroll is tilted relative to the fixed scroll due to the aforementioned overturning force acting on the movable scroll. Therefore, the fixed base plate and the distal end face of the movable spiral wrap separate from each other, which causes the refrigerant gas that has been compressed inside the compression chamber to break the oil seal that was sealing between the inflow opening and the compression chamber, whereby the inflow opening communicates with the compression chamber.

Thereupon, the refrigerant gas that has been compressed inside the compression chamber flows into the inflow opening opened to the distal end face of the movable spiral wrap. This refrigerant gas is then supplied to the back pressure chamber through the supply passage formed by the inflow opening, the communication hole, and the outflow opening, to increase the pressure inside the back pressure chamber. This scroll compressor is thus capable of always biasing the movable scroll toward the fixed scroll to a suitable extent because of the supply passage.

Since, in this scroll compressor, the pressure inside the back pressure chamber is increased before the movable scroll is tilted relative to the fixed scroll so that the movable scroll can be biased toward the fixed scroll to a suitable extent, the outer peripheries of the fixed base plate and the movable base plate are hard to come apart from each other. Accordingly, in this scroll compressor, the problem encountered in the conventional technique where the compression chamber communicates with the back pressure chamber at the outer periphery of the movable scroll and thereby causing a refrigerant gas leak, is hard to occur.

Accordingly, the scroll compressor of the present invention improves compression efficiency.

Japanese Laid-Open Patent Application No. 2000-220585 discloses a scroll compressor including a passage similar to the supply passage according to the present invention. This passage, however, is provided for reducing the pressure receiving area so as to reduce the pressure applied to the distal end face of the movable spiral wrap from the refrigerant gas at a discharge pressure inside the compression chamber, and it is not a passage for supplying the refrigerant gas at a discharge pressure inside the compression chamber into the back pressure chamber. In other words, this passage has a different function and is distinct from the supply passage according to the present invention.

In the scroll compressor of the present invention, the inflow opening is preferably opened to the distal end face at an innermost end of the movable spiral wrap (Claim 2). The innermost end of the movable spiral wrap refers to an end portion on the inner side of the movable spiral wrap that converges in a spiral manner toward the center of the movable scroll. When the movable scroll orbits around the orbit axis, and the compression chambers defined by the fixed base plate, fixed spiral wrap, the movable base plate, and the movable spiral wrap move to near the innermost end of the movable spiral wrap, the refrigerant gas inside the compression chambers are compressed to or nearly to the discharge pressure.

Therefore, with the above structure, the refrigerant gas compressed to or nearly to the discharge pressure can be supplied to the back pressure chamber through the supply passage, so that the movable scroll can be biased reliably.

In the scroll compressor of the present invention, the distal end face of the movable spiral wrap is preferably in direct sliding contact with the fixed base plate (Claim 3). In this case, since no elastic sealing member is provided to the distal end face of the movable spiral wrap, the refrigerant gas compressed to or nearly to the discharge pressure is swiftly supplied to the back pressure chamber when the movable scroll undergoes elastic deformation or displacement in the orbit axis direction. This ensures an improvement in compression efficiency.

In the scroll compressor of the present invention, the inflow opening is preferably formed by spot-facing the communication hole on the side of the fixed base plate (Claim 4). In this case, while the communication hole retains its small diameter to secure the throttling function of the supply passage, the inflow opening can be easily increased in diameter. Therefore, as compared to the case of increasing the diameter of the communication hole itself, the movable spiral wrap (in particular its foot portion) where the communication hole is formed is unlikely to lose its strength. Furthermore, the processing length of the small-diameter communication hole can be made shorter by performing a two-step process in which the inflow opening is first formed using a large-diameter spot-facing tool (such as a drill or end mill, etc.), after which the communication hole is formed using a small-diameter drilling tool. This prevents breakage of tools and an increase in tact time, and consequently, an increase in the production cost is suppressed.

In the scroll compressor of the present invention, the outflow opening is preferably formed by spot-facing the communication hole on the side of the back pressure chamber (Claim 5). In this case, while the communication hole retains its small diameter to secure the throttling function of the supply passage, the outflow opening can be easily increased in diameter. Therefore, as compared to the case of increasing the diameter of the communication hole itself, the movable spiral wrap (in particular its foot portion) where the communication hole is formed is unlikely to lose its strength. Furthermore, the processing length of the small-diameter communication hole can be made shorter by performing a two-step process in which the outflow opening is first formed using a large-diameter spot-facing tool, after which the communication hole is formed using a small-diameter drilling tool. This prevents breakage of tools and an increase in tact time, and consequently, an increase in the production cost is suppressed.

In the scroll compressor of the present invention, the discharge chamber and the back pressure chamber are preferably communicated with each other through a secondary supply passage (Claim 6). In this case, the refrigerant gas inside the discharge chamber is constantly supplied to the back pressure chamber through the secondary supply passage, so that the back pressure inside the back pressure chamber is unlikely to drop. Accordingly, the refrigerant gas inside the compression chamber needs to be supplied less frequently to the back pressure chamber through the supply passage, which leads to a further improvement in compression efficiency.

In the case with Claim 6 above, preferably, an oil separator for the separating refrigerant gas and the lubricating oil from each other is provided inside the discharge chamber; and the secondary supply passage supplies the lubricating oil separated from the refrigerant gas inside the discharge chamber to the back pressure chamber (Claim 7). Since the lubricating oil is supplied to the back pressure chamber through the secondary supply passage, wear in sliding portions facing the back pressure chamber is prevented, whereby the compressor has better durability.

In the case with Claim 6 above, preferably, an oil separator for separating the refrigerant gas and the lubricating oil from each other is provided inside the discharge chamber; and the secondary supply passage supplies the refrigerant gas separated from the lubricating oil inside the discharge chamber to the back pressure chamber (Claim 8). The refrigerant gas is supplied to the back pressure chamber through the secondary supply passage, so that, as compared to the case where the lubricating oil with a larger flow resistance is supplied, a pressure drop in the back pressure chamber can be restored swiftly.

In the scroll compressor of the present invention, the distal end face of the movable spiral wrap is preferably concavely formed with an inlet notch for constantly communicating the inflow opening and the compression chamber (Claim 9). In this case, since the refrigerant gas inside the compression chamber is constantly supplied to the back pressure chamber via the inlet notch, the back pressure in the back pressure chamber is unlikely to drop. The inlet notch may be a groove, or a rough surface.

In the scroll compressor of the present invention, preferably, a discharge port is drilled in the fixed base plate to communicate the compression chamber and the discharge chamber, and part of a trajectory of the inflow opening when the movable scroll orbits overlaps the discharge port (Claim 10). In this case, the inflow opening and the discharge port periodically communicate with each other as the movable scroll orbits. Therefore, the refrigerant gas compressed to the discharge pressure inside the compression chamber is periodically supplied to the back pressure chamber through the discharge port and the supply passage, so that the back pressure in the back pressure chamber is unlikely to drop. The discharge port may be a circular hole with an increased diameter, or may have a cutout extending in a direction in which it overlaps part of the trajectory of the inflow opening.

In the scroll compressor of the present invention, the inflow opening is preferably opened to a central portion on the distal end face of the innermost end (Claim 11).

The central portion on the distal end face of the innermost end refers to a portion described below: The compression chamber is first defined as a pair of compression chambers radially facing each other on the outer circumferential side of the movable base plate and the movable spiral wrap. Then, as the movable scroll orbits, this pair of compression chambers move toward the center, facing each other, with a progressively decreasing volume, and eventually reach the center of the fixed base plate where they merge into one compression chamber. By this stage the refrigerant gas inside the compression chamber will have been compressed to the discharge pressure. Here, a central portion on the distal end face of the innermost end refers to a portion of the distal end face adjoining the one compression chamber formed after the pair of compression chambers joined at the center of the fixed base plate.

In this case, in this scroll compressor, since the refrigerant gas compressed to the discharge pressure can be supplied to the back pressure chamber through the supply passage, the movable scroll can be swiftly biased. Further in this scroll compressor, since the inflow opening is opened to the central portion of the movable spiral wrap, the movable scroll does not easily tilt relative to the orbit axis direction even when there is an elastic deformation or displacement of the movable scroll, and therefore a refrigerant gas leak is unlikely to occur.

In the case with Claim 11 above, the inflow opening, the communication hole, and the outflow opening are preferably aligned along the orbit axis direction (Claim 12). In this case, since the supply passage can be processed easily, the production cost for this scroll compressor is further reduced. Further since the supply passage can be provided only by forming one hole on the center side of the movable scroll, the entire apparatus is reduced in size, as compared to the conventional technique of forming an annular groove at the outer periphery of the movable scroll.

In the case with Claim 11 or 12 above, the inflow opening is preferably offset toward an innermost end of the fixed spiral wrap in thickness direction of the movable spiral wrap (Claim 13).

The one compression chamber formed by the pair of compression chambers joining at the center of the fixed base plate is defined by the facing innermost ends of the movable spiral wrap and the fixed spiral wrap. Per such the one compression chamber, a next pair of compression chambers are defined on the outer circumferential side of the movable spiral wrap and the fixed spiral wrap. The refrigerant gas in the next pair of compression chambers are not compressed to the discharge pressure yet.

If the inflow opening opened to the central portion on the distal end face of the innermost end is offset toward the innermost end of the fixed spiral wrap in a thickness direction of the movable spiral wrap, when the fixed base plate comes apart from the distal end face of the innermost end of the movable spiral wrap, an oil seal sealing between the inflow opening and the one compression chamber in the center has a smaller width, as compared to an oil seal sealing between the inflow opening and the next pair of compression chambers and therefore is more breakable. Therefore, the refrigerant gas that has been compressed to the discharge pressure inside the one compression chamber can be made to flow into the inflow opening reliably, whereas an unwanted refrigerant gas leak is unlikely to occur in the next pair of compression chambers. As a result, this scroll compressor improves compression performance over the entire rpm range, and in particular, improves the compression performance remarkably in a low r.p.m. range where the above-mentioned leak can largely affect the compression performance due to the low discharge volume.

In the case with Claim 13 above, the inflow opening is preferably in an oval shape having a short side along the thickness direction of the movable spiral wrap (Claim 14). In this case, as compared to a circular inflow opening, the inflow opening can communicate with the compression chamber in a wider width (width in a direction orthogonal to the thickness direction of the movable spiral wrap) in an instance when the fixed base plate comes apart from the distal end face of the innermost end of the movable spiral wrap. The refrigerant gas is thus more readily supplied from the compression chamber to the back pressure chamber through the inflow opening, and thereby the pressure inside the back pressure chamber is increased swiftly.

BEST MODES FOR CARRYING OUT THE INVENTION

Specific examples 1 to 10 of embodiment of the present invention will be described with reference to the drawings.

Embodiment 1

Figure 1:
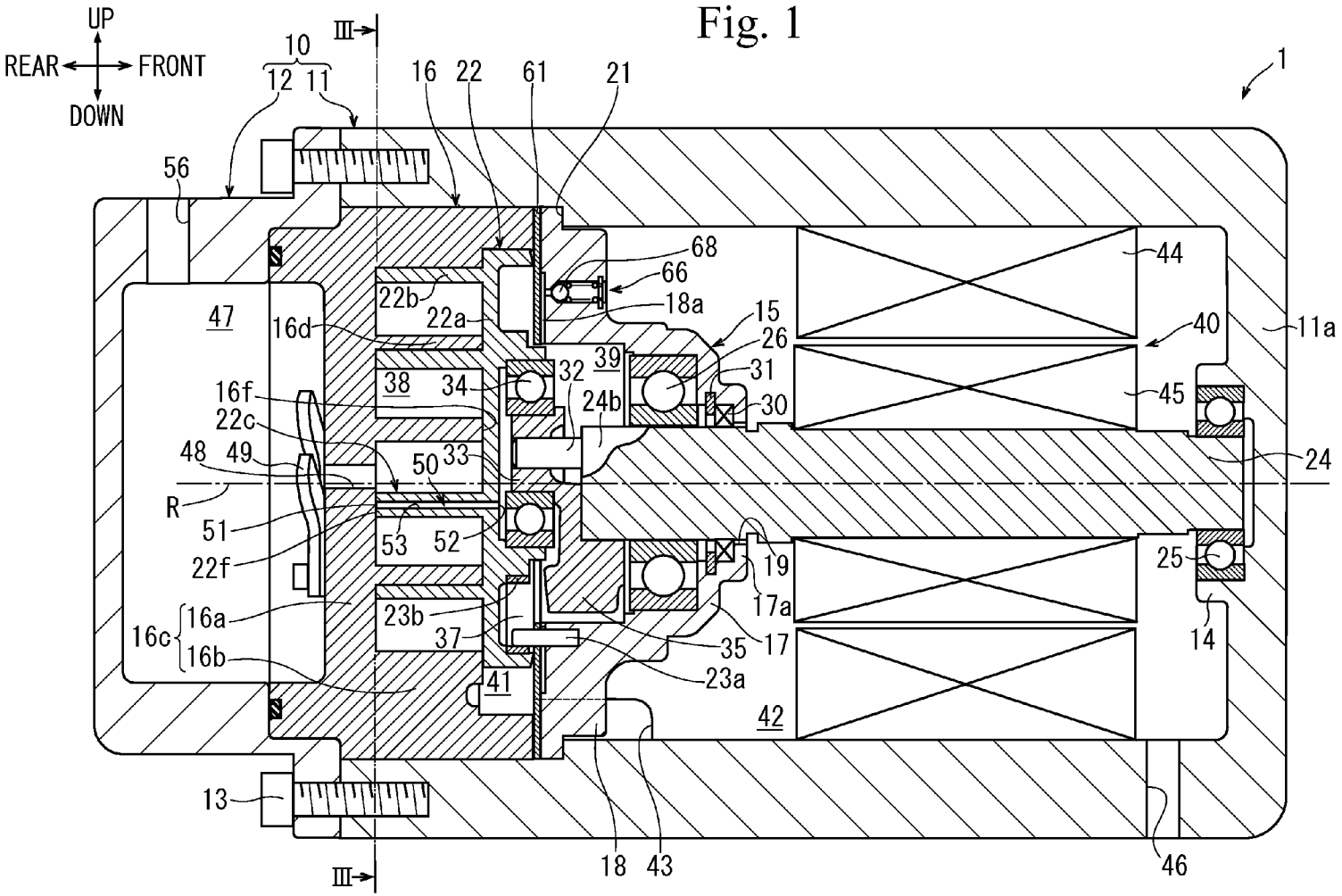
FIG. 1 is a longitudinal sectional view of a scroll compressor according to Embodiment 1.
Figure 2:
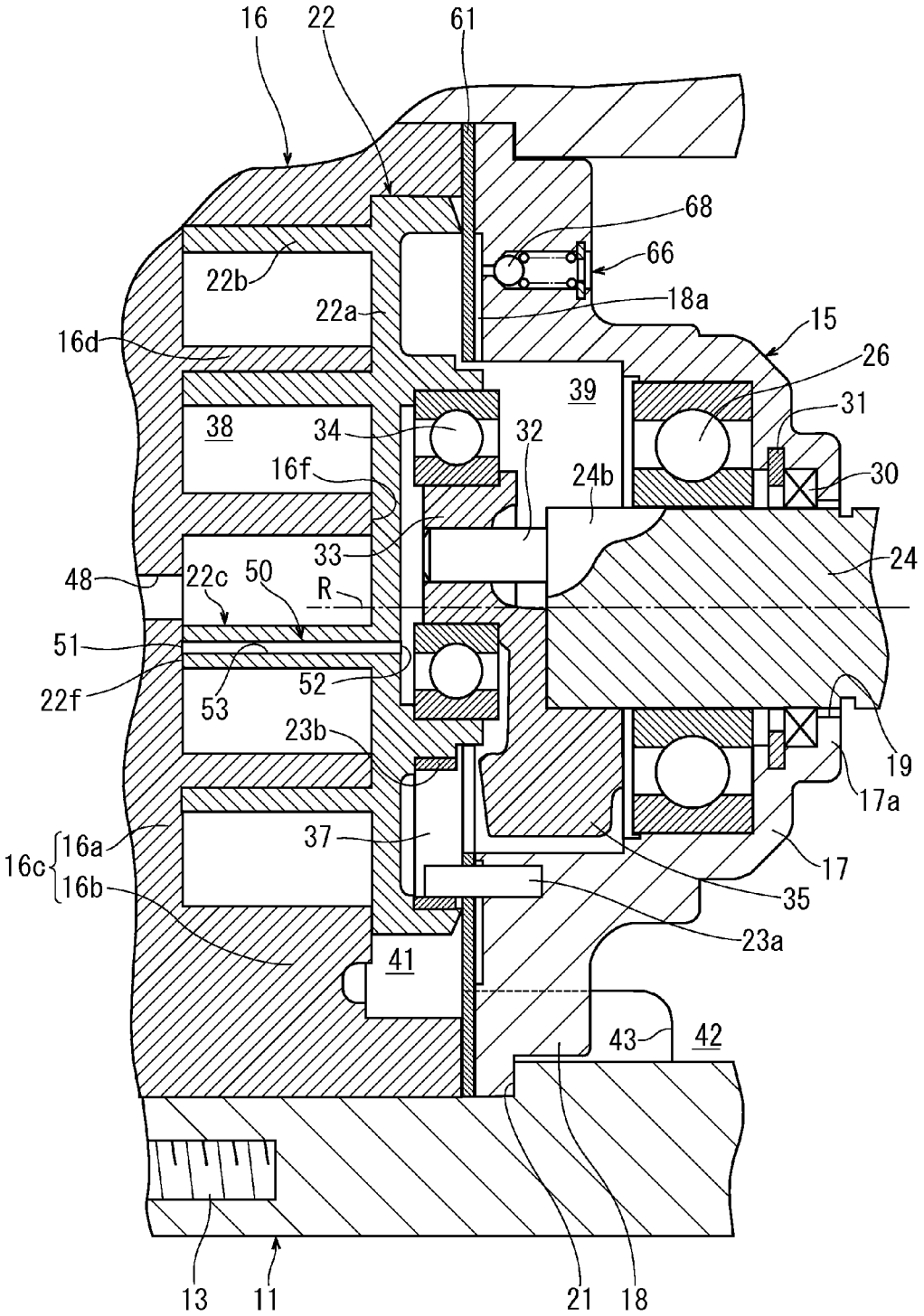
FIG. 2 is an enlarged sectional view of essential parts of the scroll compressor according to Embodiment 1.

As shown in FIGS. 1 and 2, the scroll compressor 1 of Embodiment 1 includes a housing 10. The housing 10 is made up of a cylindrical front housing 11 with a bottom and an open rear end, and a lid-formed rear housing 12 closing the rear end of the front housing 11.

Inside the front housing 11 is provided a shaft support member 15, as well as a fixed scroll 16 to the rear of the shaft support member 15. An annular-shaped, thin metal plate 61 is interposed between the fixed scroll 16 and the shaft support member 15. The front housing 11 and the rear housing 12 are fastened to each other with bolts 13, with the rear end of the front housing 11 and the front end of the rear housing 12 abutting each other, such as to accommodate the shaft support member 15, plate 61, and the fixed scroll 16 making contact with one another therein.

A cylindrical shaft support 14 is convexly formed at the center on the inner face of the bottom wall 11*a* of the front housing 11. The support shaft member 15, on the other hand, is made up of a tubular main body 17 and a flange 18 extending outwardly from the periphery of an opening at a rear end of the main body 17. A shaft hole 19 is formed through the center of the bottom wall 17*a* of the main body 17. The flange 18 abuts and is stopped by a step 21 acting as a front stop formed in the inner circumferential surface of the front housing 11. On the backside of the flange 18 is protruded a rotation preventing pin 23*a* which restricts rotation of the movable scroll 22 to be described later and allows it to orbit only.

A rotating shaft 24 extending in a front to back direction is rotatably supported at its both ends by the shaft support member 15 and the shaft support 14 via radial bearings 25 and 26. A sealing member 30 is interposed to provide a seal between the shaft support member 15 and the rotating shaft 24 with a circlip 31.

At the rear end 24*b* of the rotating shaft 24 is protruded a columnar eccentric pin 32 at a position offset from the center axis line R of the rotating shaft 24. A cylindrical bush 33 fits on and is supported by the eccentric pin 32. The center axis line R of the rotating shaft 24 coincides with the orbit axis of the movable scroll 22. An outwardly spreading fan-like balance weight 35 is integrally formed on a substantially semicircular area of the outer circumferential surface of the bush 33. This balance weight 35 serves to cancel the centrifugal force attendant with the orbital motion of the movable scroll 22 to be described later.

The fixed scroll 16 is made up of a fixed base plate 16*c* formed by a base wall 16*a* and an outer circumferential wall 16*b* in a tubular shape with a bottom, and a fixed spiral wrap 16*d* integrally formed with and rising from the front face of the base wall 16*a* inside the outer circumferential wall 16*b*.

The movable scroll 22 on the other hand is provided between the bush 33 and the fixed scroll 16 via a radial bearing 34. The movable scroll 22 is made up of a circular plate-like movable base plate 22*a* facing to the fixed base plate 16*c*, and a movable spiral wrap 22*b* integrally formed with and rising from the rear face of the movable base plate 22*a*. The movable spiral wrap 22*b* interlocks with the fixed spiral wrap 16*d*.

The distal end face 16*f* of the fixed scroll wrap 16*d* can slide on the movable base plate 22*a*, with lubricating oil contained in refrigerant gas being present therebetween. The distal end face 22*f* of the movable scroll wrap 22*b* can also slide on the fixed base plate 16*c*, with the lubricating oil contained in the refrigerant gas being present therebetween. The outer periphery of the movable base plate 22*a* can also slide against the outer periphery of the fixed base plate 16*c*, with the lubricating oil contained in the refrigerant gas being present therebetween. Oil film of this lubricating oil acts as an oil seal, whereby a seal is provided between the distal end face 16*f* and the movable base plate 22*a*, between the distal end face 22*f* and the fixed base plate 16*c*, and between the outer peripheries of the movable base plate 22*a* and the fixed base plate 16*c*.

In the front face of the movable base plate 22*a* is concavely formed a rotation preventing hole 37 in which a tip portion of the rotation preventing pin 23*a* loosely fits. A cylindrical ring 23*b* loosely fits in the rotation preventing hole 37. The rotation preventing pin 23*a* slides and rolls on the inner circumferential surface of the ring 23*b*, thereby restricting rotation of the movable scroll 22 and allowing it only to orbit around the center axis line (orbit axis) R.

Figure 3:
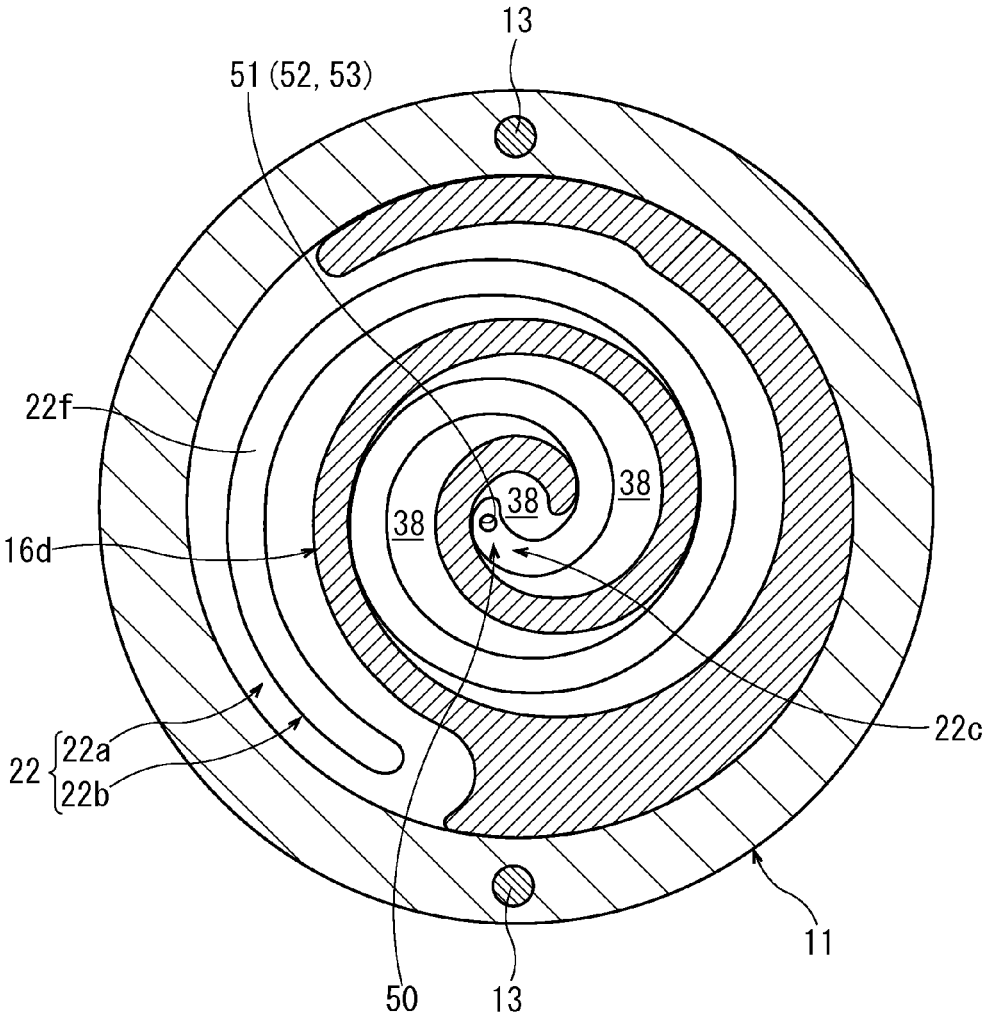
FIG. 3 is a sectional view showing a cross section along III-III of FIG. 1 of the scroll compressor according to Embodiment 1.

A compression chamber 38 is defined by the fixed base plate 16*c*, the fixed spiral wrap 16*d*, the movable base plate 22*a*, and the movable spiral wrap 22*b*. More specifically, as shown in FIG. 3, the compression chamber 38 is defined first as a radially facing pair of compression chambers 38 on the outer circumferential side of the movable base plate 22*a* and the movable spiral wrap 22*b*. As the movable scroll 22 orbits, this pair of compression chambers 38 move toward the center, facing each other, with a progressively decreasing volume, and eventually reach the center of the fixed base plate 16*c* where they merge into the one compression chamber 38. By this stage the refrigerant gas inside the compression chamber 38 will have been compressed to a discharge pressure. Here, a central portion on the distal end face 22*f* of an innermost end 22*c* refers to a portion of the distal end face 22*f* of the innermost end 22*c* adjoining the one compression chamber 38 formed after the pair of compression chambers 38 joined at the center of the fixed base plate 16*c*.

As shown in FIGS. 1 and 2, the front face of the movable base plate 22*a* abuts the rear face of the plate 61. Therefore, the movable scroll 22 makes sliding contact with the plate 61 as it orbits. Since the plate 61 is made of thin metal plate with a thickness of about 0.2 to 0.3 mm, it biases the movable scroll 22 toward the fixed scroll 16 to a suitable extent with its resilient restoring force.

On the front face side of the movable base plate 22*a* (back-side facing opposite to the compression chamber 38) between the movable base plate 22*a* and the shaft support member 15 is formed a back pressure chamber 39, in which the rear end 24*b* of the rotating shaft 24 is located. In the rear face of the shaft support member 15 is concavely formed with a ring-shaped annular recess 18*a* having its axis center coinciding with the rotating shaft 24. The back pressure chamber 39 also communicates with the annular recess 18*a* and the rotation preventing hole 37. An intake space 41 is formed between the shaft support member 15, the outer circumferential wall 16*b*, and an outermost circumferential part of the movable spiral wrap 22*b*.

Inside the front housing 11, a suction chamber 42 is formed to the front of the shaft support member 15. Inside the suction chamber 42 is a stator 44 fixed to an inner circumferential surface of the front housing 11. A rotor 45 fixed to the rotating shaft 24 is provided inside the stator 44. The rotor 45, the stator 44, and the rotating shaft 24 constitute an electric motor 40. With power applied to the stator 44, the rotor 45 and the rotating shaft 24 rotate integrally, and this driving power is transmitted to the movable scroll 22 via the eccentric pin 32 and the bush 33, thereby causing the movable scroll 22 to orbit.

An intake passage 43 is concavely formed on the rear end side in the inner circumferential surface of the front housing 11 for communicating the suction chamber 42 with the intake space 41. An intake port 46 extends through the outer circumferential wall of the front housing 11 on the front end side to communicate the suction chamber 42 with outside.

The intake port 46 is connected to an evaporator (not shown) via piping. The evaporator is further connected to an expansion valve, and a condenser via piping. The scroll compressor 1, the evaporator, the expansion valve, and the condenser constitute a refrigeration circuit of a vehicle air-conditioner. A low-pressure, low-temperature refrigerant gas in the refrigeration circuit is introduced from the intake port 46 into the suction chamber 42, and supplied through the intake passage 43 into the intake space 41.

A discharge chamber 47 is defined by connecting the rear end of the fixed base plate 16*c* and the front end of the rear housing 12. A discharge port 48 is formed through the center of the fixed base plate 16*c* so that the compression chamber 38 and the discharge chamber 47 communicate with each other through the discharge port 48. To the rear end of the fixed base plate 16 and inside the discharge chamber 47 are provided a discharge valve (not shown) for opening and closing the discharge port 48 and a retainer 49 for restricting the degree of opening of this discharge valve.

A discharge port 56 is provided through the rear housing 12 such that one end thereof communicates with the discharge chamber 47 while the other end opens to an upper part of the outer circumferential surface of the rear housing 12. The discharge port 56 is connected to the condenser (not shown) via piping. The refrigerant gas introduced into the discharge chamber 47 is exhausted through the discharge port 56 to the condenser.

As shown in FIGS. 2 and 3, the movable scroll 22 is formed with a supply passage 50 including an inflow opening 51, an outflow opening 52, and a communication hole 53. The inflow opening 51 opens to a central portion on the distal end face 22*f* of the innermost end 22*c* in the movable spiral wrap 22*b*. The innermost end 22*c* is an end portion on the inner side of the movable spiral wrap 22*b* that converges in a spiral manner toward the center of the movable scroll 22. When the movable scroll 22 orbits around the center axis line (orbit axis) R, and the compression chambers 38 move to near the innermost end 22*c* of the movable spiral wrap 22*b*, the refrigerant gas inside the compression chambers 38 is compressed to or nearly to a discharge pressure. The outflow opening 52 opens to the front face side (backside) of the movable base plate 22*a* at a position facing the rear end 24*b* of the rotating shaft 24. The communication hole 53 is a narrow hole extending straight through the movable spiral wrap 22*b* and the movable base plate 22*a* to communicate the inflow opening 51 with the outflow opening 52. Since the inflow opening 51, the communication hole 53, and the outflow opening 52 are aligned along the direction of the center axis line (orbit axis) R, they can be processed easily by one drilling operation. The inside diameter of the communication hole 53 is suitably reduced so that the flow amount of the refrigerant gas supplied from the compression chamber 38 into the back pressure chamber 39 through the supply passage 50 can be throttled to a suitable extent. In this embodiment, the inside diameter is set in a range of about 0.3 to 2.0 mm.

The suction chamber 42 communicates with the back pressure chamber 39 through a bleed passage 66 so that the refrigerant gas is returned from the back pressure chamber 39 to the suction chamber 42. The bleed passage 66 extends through the shaft support member 15 in a front to back direction, with a differential pressure regulating valve 68 in its midway. The differential pressure regulating valve 68 is normally closed, and opened only in case of an abnormal buildup in the pressure difference between the back pressure chamber 39 and the suction chamber 42 to return the refrigerant gas from the back pressure chamber 39 to the suction chamber 42 so as to resolve the condition in which the pressure difference between the back pressure chamber 39 and the suction chamber 42 is abnormally high. Although not shown, in addition to the differential pressure regulating valve 68, a communication passage may be provided, which may be formed by a first opening opened opposite to the inner race of the radial bearing 25 with a gap therebetween at the front end of the rotating shaft 24, a second opening opened to the back pressure chamber 39 at the rear end 24*b* of the rotating shaft 24, and a communication hole communicating the first opening with the second opening. In this case, the gap between the inner race of the radial bearing 25 and the opposite first opening will act as a fixed throttle, whereby the pressure inside the back pressure chamber 39 is suppressed to a certain low level.

The scroll compressor 1 configured as described above operates as follows. When a vehicle driver operates the vehicle air-conditioner, a motor control circuit (not shown) controls the electric motor 40 based on it, to rotate the rotor 45 and the rotating shaft 24. This causes the eccentric pin 32 to spin around the axis center of the fixed scroll 16. At this time, the movable scroll 22 is prevented from rotating and allowed only to orbit around the center axis line (orbit axis) R because the rotation preventing pin 23*a* slides and rolls along the inner circumferential surface of the ring 23*b*. With the movable scroll 22 orbiting, the compression chambers 38 move from the outer circumference side toward the center side of the spiral wraps 16*d* and 22*b* of both scrolls 16 and 22 with a progressively decreasing volume. Thereby, the refrigerant gas supplied from the evaporator to the suction chamber 42 via the intake port 46 is introduced into the intake space 41 through the intake passage 43, and further taken in from the intake space 41 into the compression chambers 38, and compressed. The refrigerant gas compressed to a discharge pressure is discharged from the discharge port 48 into the discharge chamber 47, and exhausted through the discharge port 56 to the condenser. Air-conditioning is thus performed by the vehicle air-conditioner.

Now, in this scroll compressor 1, when the back pressure inside the back pressure chamber 39 is at an appropriate level so that the movable scroll 22 is biased toward the fixed scroll 16 to a suitable extent, the fixed base plate 16*c* is in direct sliding contact with the distal end face 22*f* of the movable spiral wrap 22*b*. The inflow opening 51 is not provided with an elastic sealing member therearound. Instead, the fixed base plate 16*c* and the distal end face 22*f* of the movable spiral wrap 22*b* slide against each other with the lubricating oil contained in the refrigerant gas being present therebetween. Therefore, the oil film of this lubricating oil acts as an oil seal to provide a seal between the fixed base plate 16*c* and the distal end face 22*f*. Accordingly, a seal is provided also between the inflow opening 51 and the compression chamber 38. This maintains the condition where the movable scroll 22 is biased toward the fixed scroll 16 to a suitable extent, whereby a power loss is hard to occur in the orbital movement of the movable scroll, and a refrigerant gas leak is unlikely to occur.

Figure 4:
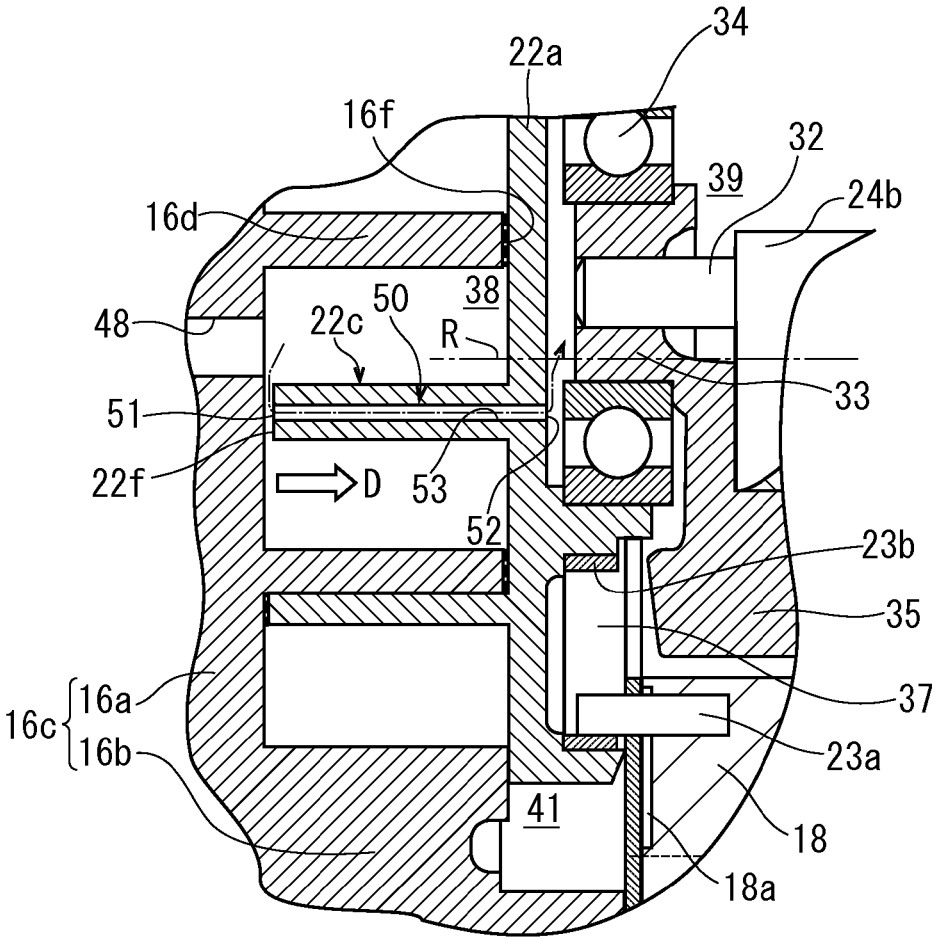
FIG. 4 is an enlarged sectional view of essential parts of the scroll compressor according to Embodiment 1.

On the other hand, if, at the start-up or during high-load operation or the like, the back pressure in the back pressure chamber 39 is insufficient and the movable scroll 22 cannot be biased sufficiently toward the fixed scroll 16, then the center side of the movable scroll 22 deforms elastically in a direction away from the fixed scroll 16, or the movable scroll 22 itself is slightly displaced in the direction of the center axis line (orbit axis) R as shown in FIG. 4 (indicated with an arrow D in FIG. 4). Such an elastic deformation or slight displacement in the direction of the center axis line (orbit axis) R occurs before the movable scroll 22 is tilted relative to the fixed scroll 16 due to the aforementioned overturning force acting on the movable scroll 22. Therefore, the fixed base plate 16*c* comes apart from the distal end face 22*f* of the innermost end 22*c* in the movable spiral wrap 22*b*, which causes the refrigerant gas that has been compressed to the discharge pressure inside the compression chamber 38 to break the oil seal that was sealing between the fixed base plate 16*c* and the distal end face 22*f* near the inflow opening 51, whereby the inflow opening 51 communicates with the compression chamber 38. On this instance, the oil seal that seals between the outer peripheries of the fixed base plate 16*c* and the movable base plate 22*a* is subjected only to the refrigerant gas at a low pressure close to the intake pressure. Therefore, the oil seal between the outer peripheries of the fixed base plate 16*c* and the movable base plate 22*a* is hard to be broken.

Thereupon, the refrigerant gas that has been compressed to the discharge pressure inside the compression chamber 38 flows into the inflow opening 51 opened to the central portion on the distal end face 22*f* of the innermost end 22*c*. This refrigerant gas is then supplied to the back pressure chamber 39 through the supply passage 50 formed by the inflow opening 51, the communication hole 53, and the outflow opening 52, to raise the pressure inside the back pressure chamber 39. This scroll compressor 1 is thus capable of always biasing the movable scroll 22 toward the fixed scroll 16 to a suitable extent because of the supply passage 50.

Since, in this scroll compressor 1, the pressure inside the back pressure chamber 39 is increased before the movable scroll 22 is tilted relative to the fixed scroll 16 so that the movable scroll 22 can be biased toward the fixed scroll 16 to a suitable extent, the outer peripheries of the fixed base plate 16*c* and the movable base plate 22*a* are hard to be separated from each other. Accordingly, in this scroll compressor 1, the problem encountered in the conventional technique where the compression chamber 38 communicates with the back pressure chamber 39 at the outer periphery of the movable scroll 22, causing a refrigerant gas leak, is hard to occur.

In this scroll compressor 1, in particular, since the distal end face 22*f* of the movable spiral wrap 22*b* is in direct sliding contact with the fixed base plate 16*c* and since no elastic sealing member is provided to the distal end face 22*f* of the movable spiral wrap 22*b*, an elastic deformation or displacement in the orbit axis direction of the movable scroll 22 causes the refrigerant gas that has been compressed to or nearly to the discharge pressure to be swiftly supplied to the back pressure chamber 39.

Accordingly, the scroll compressor 1 of Embodiment 1 improves compression efficiency.

Moreover, in this scroll compressor 1, since the supply passage 50 has a simple structure without a sealing member, the number of processing steps and the number of components is reduced, and as a consequence, the production cost is reduced.

In this scroll compressor 1, in particular, since the inflow opening 51 is opened to a central portion on the distal end face 22*f* of the innermost end 22*c*, the movable scroll 22 can be swiftly biased by supplying the high-pressure refrigerant gas compressed to the discharge pressure to the back pressure chamber 39 through the supply passage 50. Also, in this scroll compressor 1, since the inflow opening 51 is opened to a central portion on the distal end face 22*f* of the innermost end 22*c*, the movable scroll 22 does not easily tilt in the direction of the center axis line (orbit axis) R even when there is an elastic deformation or slight displacement in the direction of the center axis line (orbit axis) R of the movable scroll 22, and therefore a refrigerant gas leak is unlikely to occur.

Furthermore, in this scroll compressor 1, since the inflow opening 51, the communication hole 53, and the outflow opening 52 aligned along the direction of the center axis line (orbit axis) R are formed easily by one drilling operation, the production cost is reduced further. Since they can be provided only by forming a hole on the center side of the movable scroll 22, the entire apparatus is reduced in size, as compared to the conventional technique of forming an annular groove at the outer periphery of the movable scroll.

Embodiment 2

Figure 5:
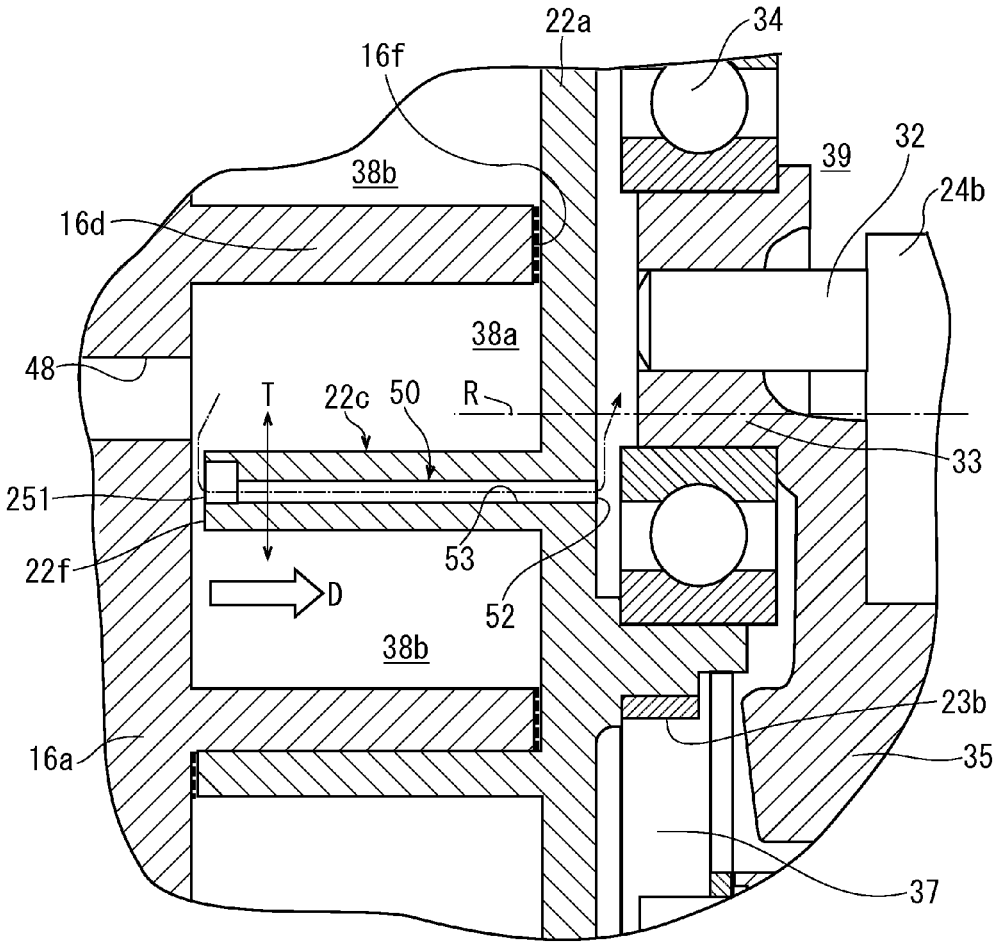
FIG. 5 is an enlarged sectional view of essential parts of a scroll compressor according to Embodiment 2.
Figure 6:
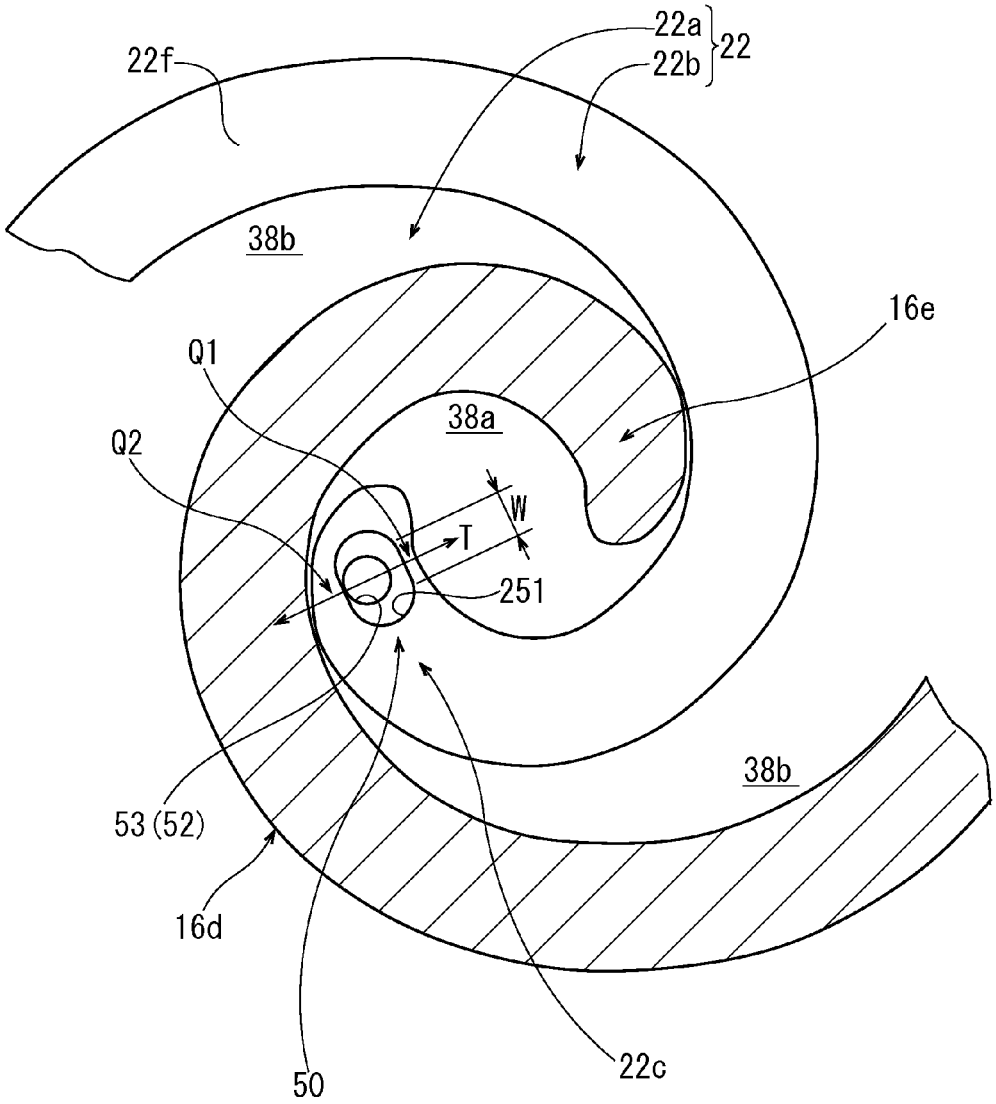
FIG. 6 is a sectional view showing a cross section along III-III of FIG. 1 of the scroll compressor according to Embodiment 2.

The scroll compressor of Embodiment 2 employs an inflow opening 251 shown in FIGS. 5 and 6 instead of the inflow opening 51 of the scroll compressor 1 of Embodiment 1. Other elements are configured similarly to the scroll compressor 1 of Embodiment 1, and therefore the same elements are given the same reference numerals and description thereof will be omitted or simplified.

As shown in FIGS. 5 and 6, in the scroll compressor of Embodiment 2, the inflow opening 251 opens to a central portion on the distal end face 22*f* of the innermost end 22*c* in the movable spiral wrap 22*b*. The inflow opening 251 is concavely formed in an oval shape by spot-facing one end of the communication hole 53 on the side of the base wall 16*a* with an end mill or the like. The inflow opening 251 is eccentric relative to the center axis of the communication hole 53, offset toward the innermost end 16*e* of the fixed spiral wrap 16*d* in a thickness direction T of the movable spiral wrap 22*b*.

With the scroll compressor of Embodiment 2 with this structure, the same actions and effects as those of the scroll compressor 1 of Embodiment 1 can be achieved.

Figure 7:
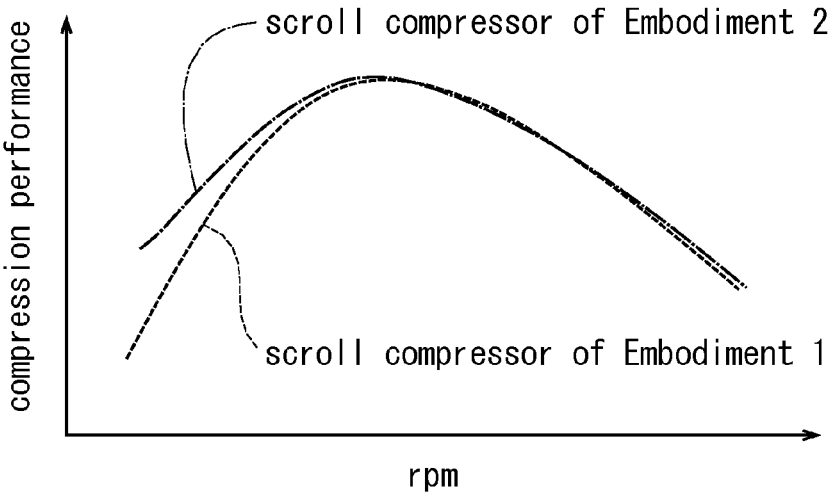
FIG. 7 is a graph showing a comparison of compression performance between the scroll compressors of Embodiment 1 and Embodiment 2.

In this scroll compressor, when the base wall 16*a* comes apart from the distal end face 22*f* of the innermost end 22*c* in the movable spiral wrap 22*b*, an oil seal Q1 sealing between the inflow opening 251 and the one compression chamber 38*a* in the center has a smaller seal width, in the thickness direction T of the movable spiral wrap 22*b*, than an oil seal Q2 sealing between the inflow opening 251 offset toward the innermost end 16*e* of the fixed spiral wrap 16*d* and compression chamber 38*b*, and therefore is more breakable. Therefore, the refrigerant gas that has been compressed to the discharge pressure inside the compression chamber 38*a* can be made to flow into the inflow opening 251 reliably, whereas an unwanted refrigerant gas leak to the side of the compression chamber 38*b* is unlikely to occur. As a result, this scroll compressor improves compression performance over the entire rpm range as compared to the scroll compressor 1 of Embodiment 1 as shown in FIG. 7, and in particular, improves the compression performance remarkably in a low rpm range where the above-mentioned leak can largely affect the compression performance due to the low discharge volume.

Moreover, in this scroll compressor, the inflow opening 251 is formed by spot-facing one end of the communication hole 53 on the side of the fixed base plate 16*c*. Therefore, while the communication hole 53 retains its small diameter to secure the throttling function of the supply passage 50, the inflow opening 251 can be easily increased in diameter. It also means that the communication hole 53 itself need not be offset toward the innermost end 16*e* of the fixed spiral wrap 16*d* in the thickness direction T of the movable spiral wrap 22*b*. Consequently, this scroll compressor suppresses an increase in the production cost.

In this scroll compressor, the inflow opening 251 is in an oval shape having its short side along the thickness direction T of the movable spiral wrap 22*b*. Therefore, as compared to a circular inflow opening having the same diameter as the short side of the inflow opening 251, the inflow opening 251 can communicate with the compression chamber 38*a* in a wider width W (width W in the direction orthogonal to the thickness direction T of the movable spiral wrap 22*b* as shown in FIG. 6) in an instance when the fixed base plate 16*c* is separated from the distal end face 22*f* of the innermost end 22*c* in the movable spiral wrap 22*b*. The refrigerant gas is thus more readily supplied from the compression chamber 38*a* to the back pressure chamber 39 through the inflow opening 251, and thereby the pressure inside the back pressure chamber 39 is increased swiftly.

Embodiment 3

Figure 8:
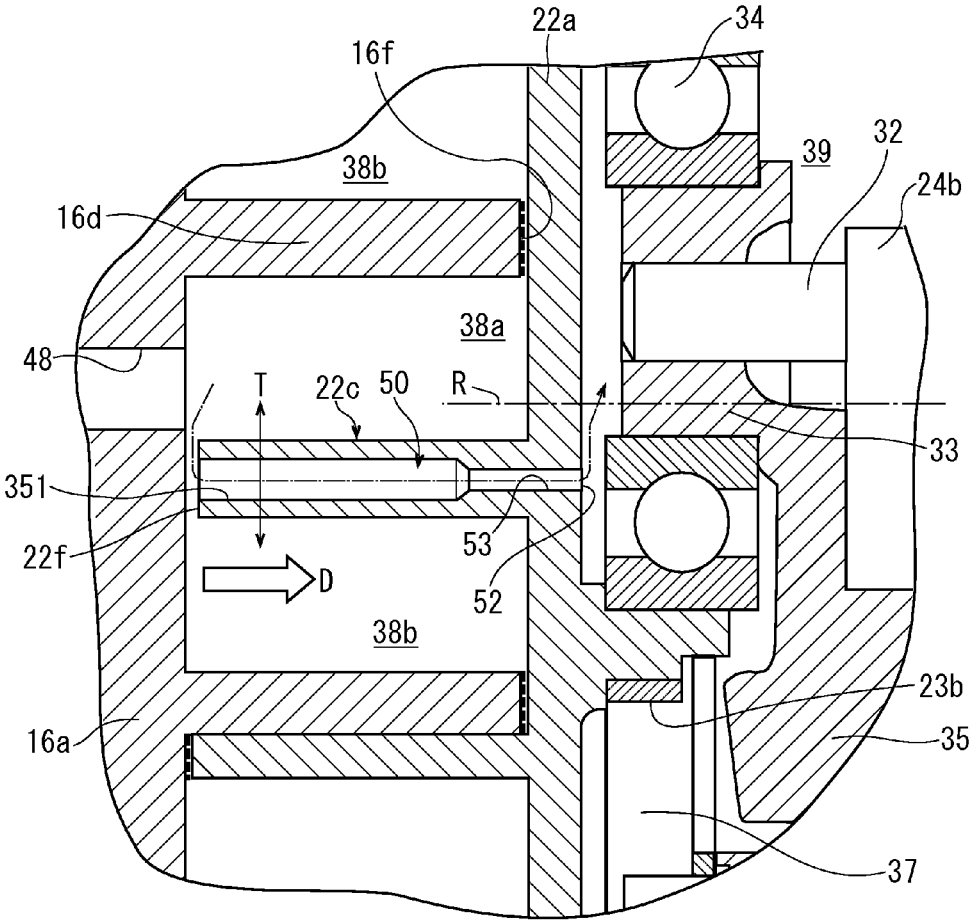
FIG. 8 is an enlarged sectional view of essential parts of a scroll compressor according to Embodiment 3.

The scroll compressor of Embodiment 3 employs an inflow opening 351 shown in FIG. 8 instead of the inflow opening 51 of the scroll compressor 1 of Embodiment 1. Other elements are configured similarly to the scroll compressor 1 of Embodiment 1, and therefore the same elements are given the same reference numerals and description thereof will be omitted or simplified.

As shown in FIG. 8, in the scroll compressor of Embodiment 3, the inflow opening 351 opens to a central portion on the distal end face 22*f* of the innermost end 22*c* in the movable spiral wrap 22*b*. The inflow opening 351 is concavely formed using a large-diameter drill or an end mill, etc. in parallel to the center axis line R of the rotating shaft 24, from the central portion of the distal end face 22*f* of the innermost end 22*c* to near the foot of the movable spiral wrap 22*b*. The inflow opening 351 may be, for example, circular, or may also be oval.

In Embodiment 3, the outflow opening 52 and the communication hole 53 are formed, after the processing of the inflow opening 351, by a drilling process using one small-diameter drill or the like in parallel to the center axis line R of the rotating shaft 24 from the side of the back pressure chamber 39 of the movable base plate 22*a* toward the inflow opening 351.

With the scroll compressor of Embodiment 3 with this structure, the same actions and effects as those of the scroll compressor 1 of Embodiment 1 or 2 can be achieved.

With this scroll compressor, while the communication hole 53 retains its small diameter to secure the throttling function of the supply passage 50, the inflow opening 351 can be easily increased in diameter. Therefore, as compared to the case of increasing the diameter of the communication hole 53 itself, the movable spiral wrap 22*b* (in particular its foot portion) where the communication hole 53 is formed is unlikely to lose its strength. Furthermore, the processing length of the small-diameter communication hole 53 can be made shorter by performing a two-step process in which the inflow opening 351 is first formed using a large-diameter spot-facing tool, after which the outflow opening 52 and communication hole 53 are formed using a small-diameter drilling tool. This prevents breakage of tools and an increase in takt time, and consequently, an increase in the production cost is suppressed.

Embodiment 4

Figure 9:
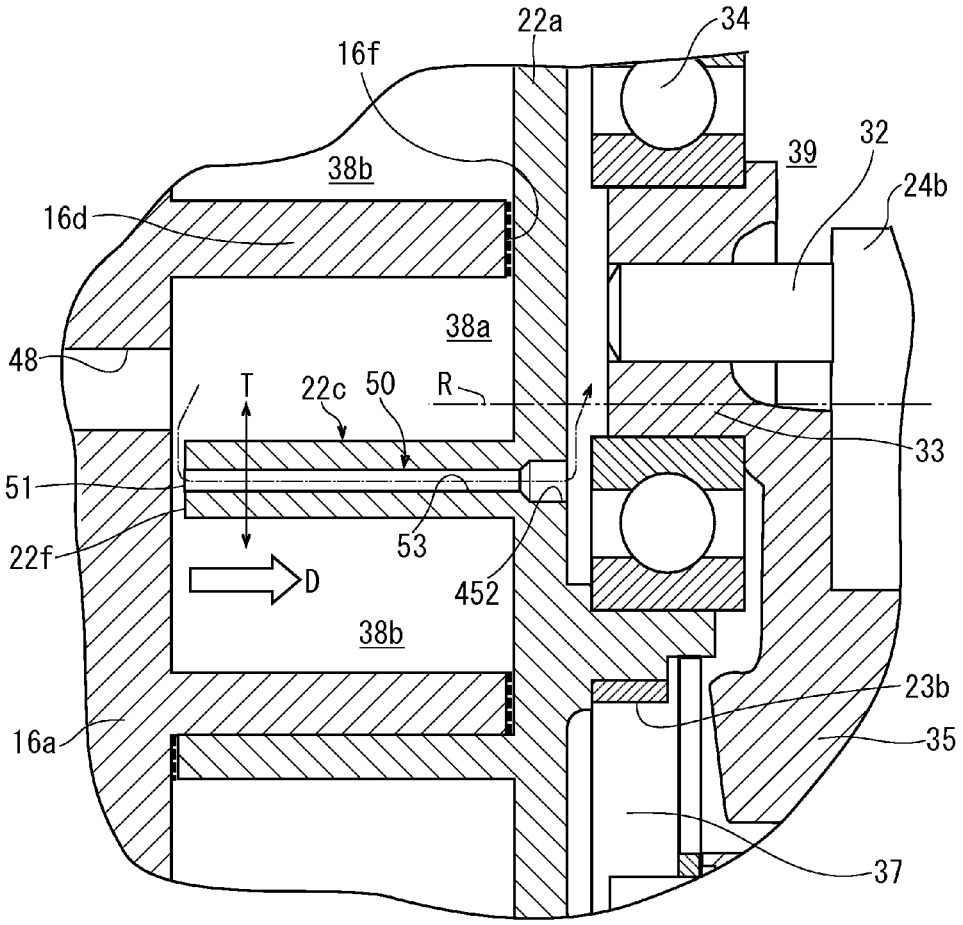
FIG. 9 is an enlarged sectional view of essential parts of a scroll compressor according to Embodiment 4.

The scroll compressor of Embodiment 4 employs an outflow opening 452 shown in FIG. 9 instead of the outflow opening 52 of the scroll compressor 1 of Embodiment 1. Other elements are configured similarly to the scroll compressor 1 of Embodiment 1, and therefore the same elements are given the same reference numerals and description thereof will be omitted or simplified.

As shown in FIG. 9, in the scroll compressor of Embodiment 4, the outflow opening 452 is concavely formed using a large-diameter drill or an end mill, etc. in parallel to the center axis line R of the rotating shaft 24, from the side of the back pressure chamber 39 of the movable base plate 22*a* to a point before the foot of the movable spiral wrap 22*b*. The outflow opening 452 may be, for example, circular, or may also be oval.

In Embodiment 4, the inflow opening 51 and the communication hole 53 are formed, after the processing of the outflow opening 452, by a drilling process using one small-diameter drill or the like in parallel to the center axis line R of the rotating shaft 24 from the side of the base wall 16*a* toward the outflow opening 452.

With the scroll compressor of Embodiment 4 with this structure, the same actions and effects as those of the scroll compressor 1 of Embodiment 1 can be achieved.

With this scroll compressor, while the communication hole 53 retains its small diameter to secure the throttling function of the supply passage 50, the outflow opening 452 can be easily increased in diameter. Therefore, as compared to the case of increasing the diameter of the communication hole 53 itself, the movable spiral wrap 22*b* (in particular its foot portion) where the communication hole 53 is formed is unlikely to lose its strength. Furthermore, the processing length of the small-diameter communication hole 53 can be made shorter by performing a two-step process in which the outflow opening 452 is first formed using a large-diameter spot-facing tool, after which the inflow opening 51 and the communication hole 53 are formed using a small-diameter drilling tool. This prevents breakage of tools and an increase in tact time, and consequently, an increase in the production cost is suppressed.

Embodiment 5

Figure 10:
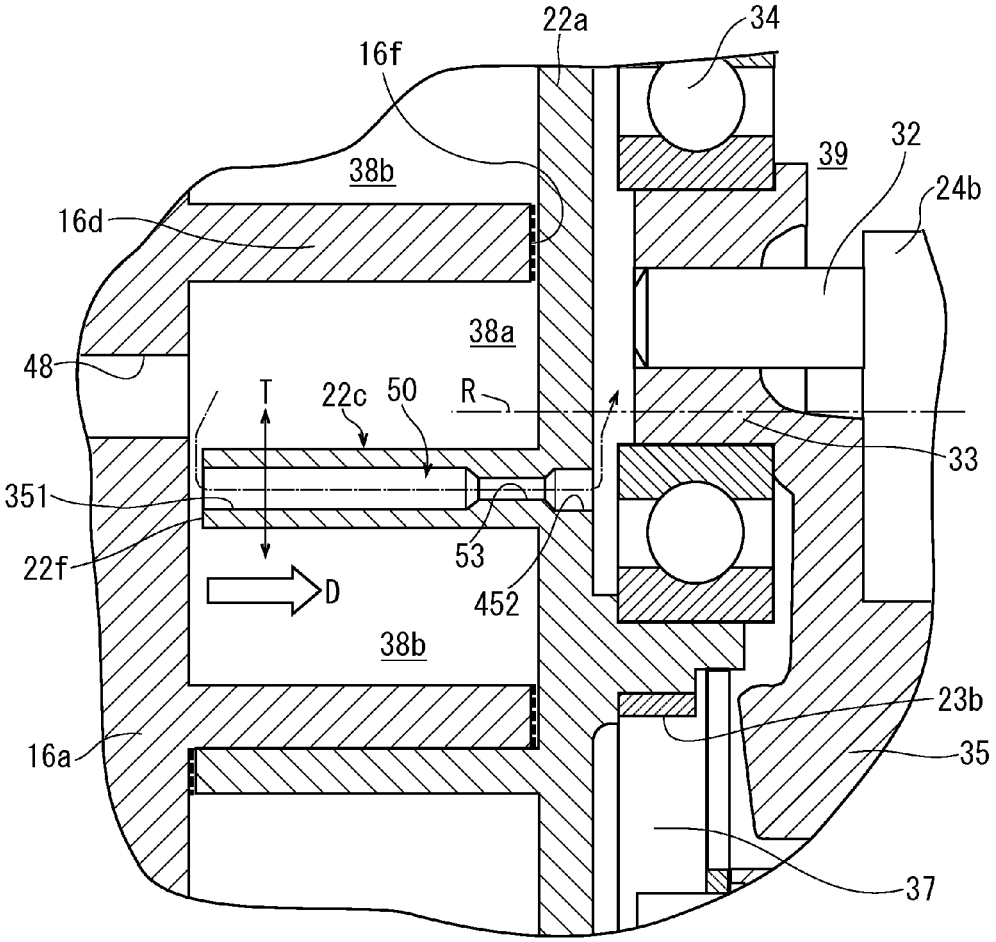
FIG. 10 is an enlarged sectional view of essential parts of a scroll compressor according to Embodiment 5.

The scroll compressor of Embodiment 5 employs an inflow opening 351 and an outflow opening 452 shown in FIG. 10 instead of the inflow opening 51 and the outflow opening 52 of the scroll compressor 1 of Embodiment 1. Other elements are configured similarly to the scroll compressor 1 of Embodiment 1, and therefore the same elements are given the same reference numerals and description thereof will be omitted or simplified.

As shown in FIG. 10, in the scroll compressor of Embodiment 5, the same inflow opening 351 described in Embodiment 3 and the same outflow opening 452 described in Embodiment 4 are employed without changes.

In Embodiment 5, the communication hole 53 is formed, after the processing of the inflow opening 351 and the outflow opening 452, by a drilling process using one small-diameter drill or the like in parallel to the center axis line R of the rotating shaft 24 from the side of the back pressure chamber 39 of the movable base plate 22*a* toward the inflow opening 351. Therefore, as compared to Embodiments 1 to 4, the processing length of the communication hole 53 can be made much shorter, whereby an increase in the production cost is surely suppressed.

With the scroll compressor of Embodiment 5 with this structure, the same actions and effects as those of the scroll compressors 1 of Embodiments 1 to 4 can be achieved.

Embodiment 6

Figure 11:
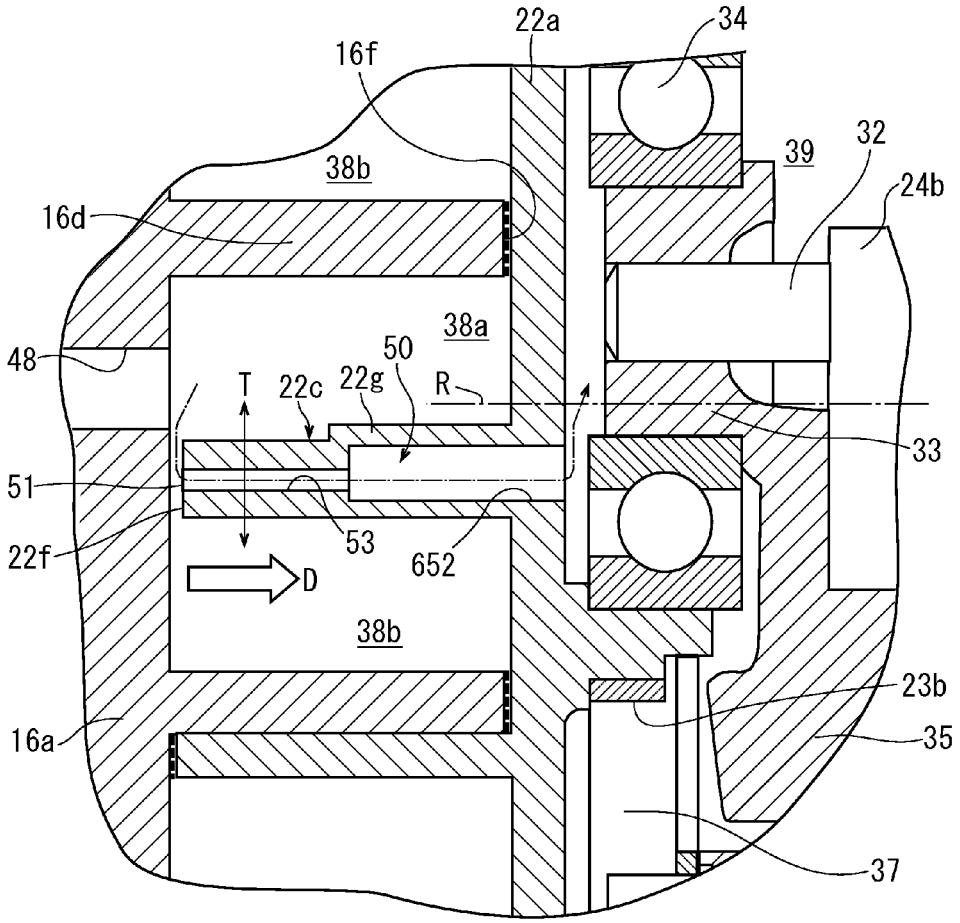
FIG. 11 is an enlarged sectional view of essential parts of a scroll compressor according to Embodiment 6.

The scroll compressor of Embodiment 6 employs an outflow opening 652 and a bulged portion 22*g* shown in FIG. 11 instead of the outflow opening 52 of the scroll compressor 1 of Embodiment 1. Other elements are configured similarly to the scroll compressor 1 of Embodiment 1, and therefore the same elements are given the same reference numerals and description thereof will be omitted or simplified.

As shown in FIG. 11, in the scroll compressor of Embodiment 6, the outflow opening 652 is concavely formed using a large-diameter drill or an end mill, etc. in parallel to the center axis line R of the rotating shaft 24, from the side of the back pressure chamber 39 of the movable base plate 22*a* to a mid point of the movable spiral wrap 22*b*. The outflow opening 652 may be, for example, circular, or may also be oval. Here, if the outflow opening 652 were to be processed in the movable spiral wrap 22*b* of Embodiment 1, the wall thickness of the movable spiral wrap 22*b* near the outflow opening 652 would be excessively thin. For this reason, the step-like bulged portion 22*g* bulging out in the thickness direction T of the movable spiral wrap 22*b* is preliminarily formed integrally near the outflow opening 652 of the movable spiral wrap 22*b*. This bulged portion 22*g* provides a sufficient wall thickness to the movable spiral wrap 22*b* even near the outflow opening 652. The outflow opening 652 can be made even larger in diameter by increasing the bulged portion 22*g*.

In Embodiment 6, the inflow opening 51 and the communication hole 53 are formed, after the processing of the outflow opening 652, by a drilling process using one small-diameter drill or the like in parallel to the center axis line R of the rotating shaft 24 from the side of the base wall 16*a* toward the outflow opening 652. In Embodiment 6, to correspond to the partial increase in wall thickness of the movable spiral wrap 22*b*, a portion of the innermost end of the fixed spiral wrap 16*d* in sliding contact with the bulged portion 22*g* is made to have a smaller wall thickness.

With the scroll compressor of Embodiment 6 with this structure, the same actions and effects as those of the scroll compressors 1 of Embodiments 1 and 4 can be achieved.

Embodiment 7

Figure 12:
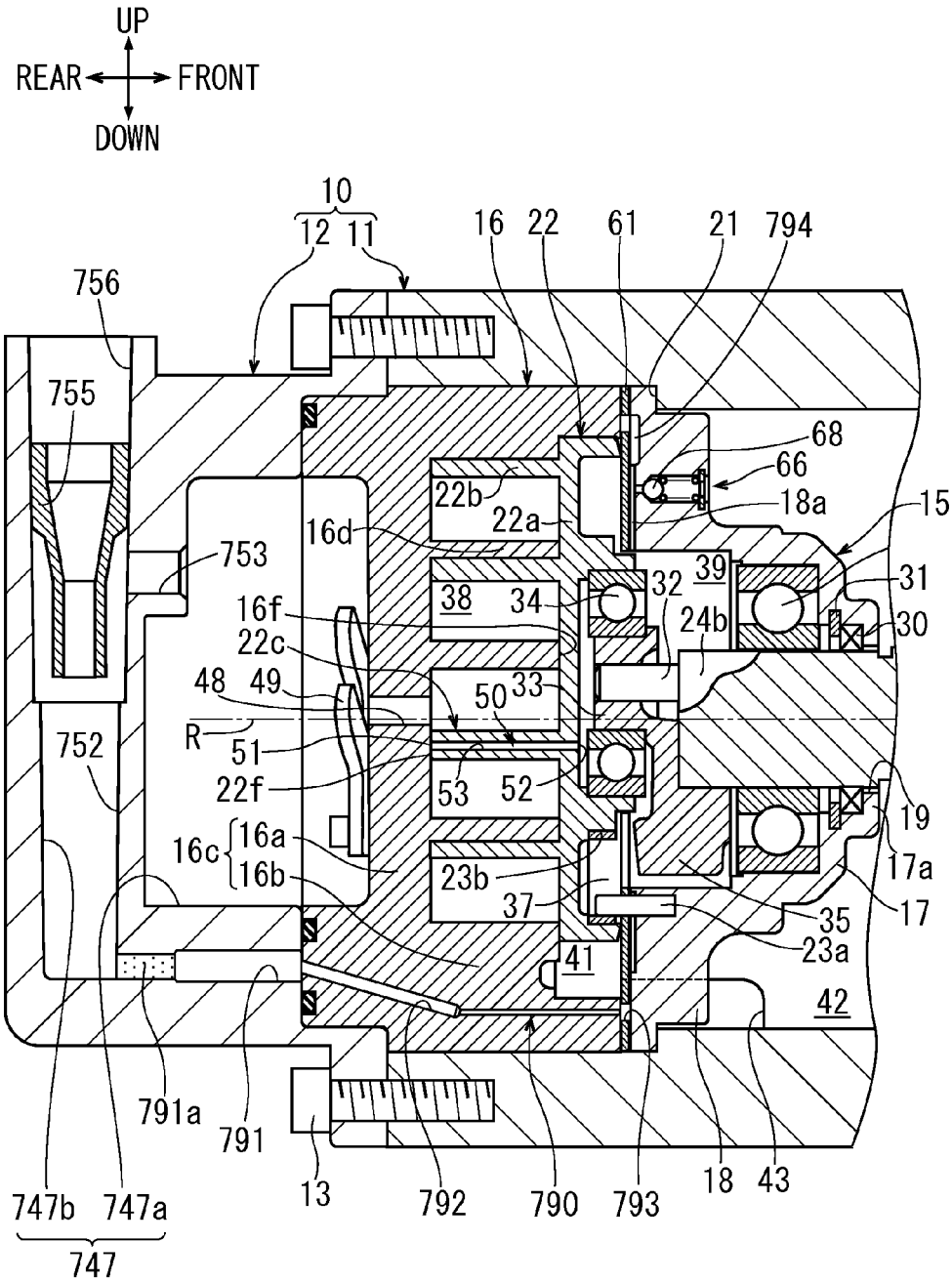
FIG. 12 is an enlarged sectional view of essential parts of a scroll compressor according to Embodiment 7.

The scroll compressor of Embodiment 7 employs a discharge chamber 747 and a secondary supply passage 790 shown in FIG. 12 instead of the discharge chamber 47 of the scroll compressor 1 of Embodiment 1. Other elements are configured similarly to the scroll compressor 1 of Embodiment 1, and therefore, the same elements are given the same reference numerals and description thereof will be omitted or simplified.

As shown in FIG. 12, in the scroll compressor of Embodiment 7, the discharge chamber 747 is formed by a main discharge chamber 747*a* and an oil separation chamber 747*b*. The main discharge chamber 747*a* is formed between the rear end of the fixed base plate 16*c* and the front end of the rear housing 12. The oil separation chamber 747*b* on the other hand is formed to the rear of the main discharge chamber 747*a* inside the rear housing 12 in a shape that extends in an up and down direction in a vehicle-mounted orientation.

A partition 752 is provided between the main discharge chamber 747*a* and the oil separation chamber 747*b* with a communication hole 753 formed through the partition 752 for communicating the main discharge chamber 747*a* and the oil separation chamber 747*b*. Inside the oil separation chamber 747*b* is provided an oil separator 755 for separating the lubricating oil from the refrigerant gas containing the lubricating oil. The oil separator 755 is cylindrical and accommodated inside the oil separation chamber 747*b* such as to snugly fit therein. The refrigerant gas introduced from the main discharge chamber 747*a* into the oil separation chamber 747*b* through the communication hole 753 is centrifuged by the oil separator 755 so as to separate the lubricating oil from the refrigerant gas. The separated lubricating oil drops down and accumulates at the bottom of the oil separation chamber 747*b*.

A discharge port 756 is provided above the oil separator 755 in the oil separation chamber 747*b* so as to penetrate through an upper part of the outer circumferential surface of the rear housing 12. The discharge port 756 is connected to the condenser (not shown) via piping. The refrigerant gas from which the lubricating oil has been separated inside the oil separation chamber 747*b* is exhausted through the discharge port 756 to the condenser.

The bottom part of the oil separation chamber 747*b* is in communication with the back pressure chamber 39 via the secondary supply passage 790. The secondary supply passage 790 is made up of a communication hole 791 formed in the rear housing 12, a communication hole 792 formed in the fixed scroll 16, a slit 793 formed in the plate 61, and a groove 794 formed to the shaft support member 15.

The communication hole 791 is a hole that communicates the front face of the rear housing 12 with the bottom part of the oil separation chamber 747*b*. A filter 791*a* is inserted into the communication hole 791 so as to remove foreign matter contained in the lubricating oil in the oil separation chamber 747*b*. The communication hole 792 is a long, narrow hole extending through the outer circumferential wall 16*b* on the lower side of the fixed scroll 16 in a front to back direction. The slit 793 is a thin slot cut out in a circular arc shape with an angle of about 180° on the outer circumferential side of the plate 61 interposed between the shaft support member 15 and the movable scroll 22. The groove 794 is a thin groove concavely formed radially outward from the annular recess 18*a* on the outer circumferential side on the rear face of the shaft support member 15.

One secondary supply passage 790 is thus formed by the communication hole 791, the communication hole 792, the slit 793, and the groove 794 which are communicated with one another in this order from the bottom of the oil separation chamber 747*b* as the upstream side. The slit 793 functions as a throttle for throttling the secondary supply passage 790 on the upstream side of the back pressure chamber 39.

With the scroll compressor of Embodiment 7 with this structure, the same actions and effects as those of the scroll compressor 1 of Embodiment 1 can be achieved.

In this scroll compressor, the lubricating oil separated from the refrigerant gas by the oil separator 755 drops down and accumulates at the bottom of the oil separation chamber 747*b*. This lubricating oil is then supplied in a small amount, with refrigerant gas in a small amount, constantly to the back pressure chamber 39 through the secondary supply passage 790. Therefore, as compared to the scroll compressor of Embodiment 1, the back pressure inside the back pressure chamber 39 is unlikely to drop. Accordingly, the refrigerant gas inside the compression chamber 38 needs to be supplied less frequently to the back pressure chamber 39 through the supply passage 50. As a result, this scroll compressor improves compression performance over the entire rpm range as compared to the scroll compressor 1 of Embodiment 1, and in particular, improves the compression performance remarkably in a low rpm range where the above-mentioned leak can largely affect the compression performance due to the low discharge volume.

Also in this scroll compressor, the lubricating oil supplied from the bottom of the oil separation chamber 747*b* to the back pressure chamber 39 through the secondary supply passage 790 prevents wear of sliding portions facing the back pressure chamber 39 (for example the sliding surfaces between the plate 61 and the movable scroll 22), whereby the compressor has better durability.

Embodiment 8

Figure 13:
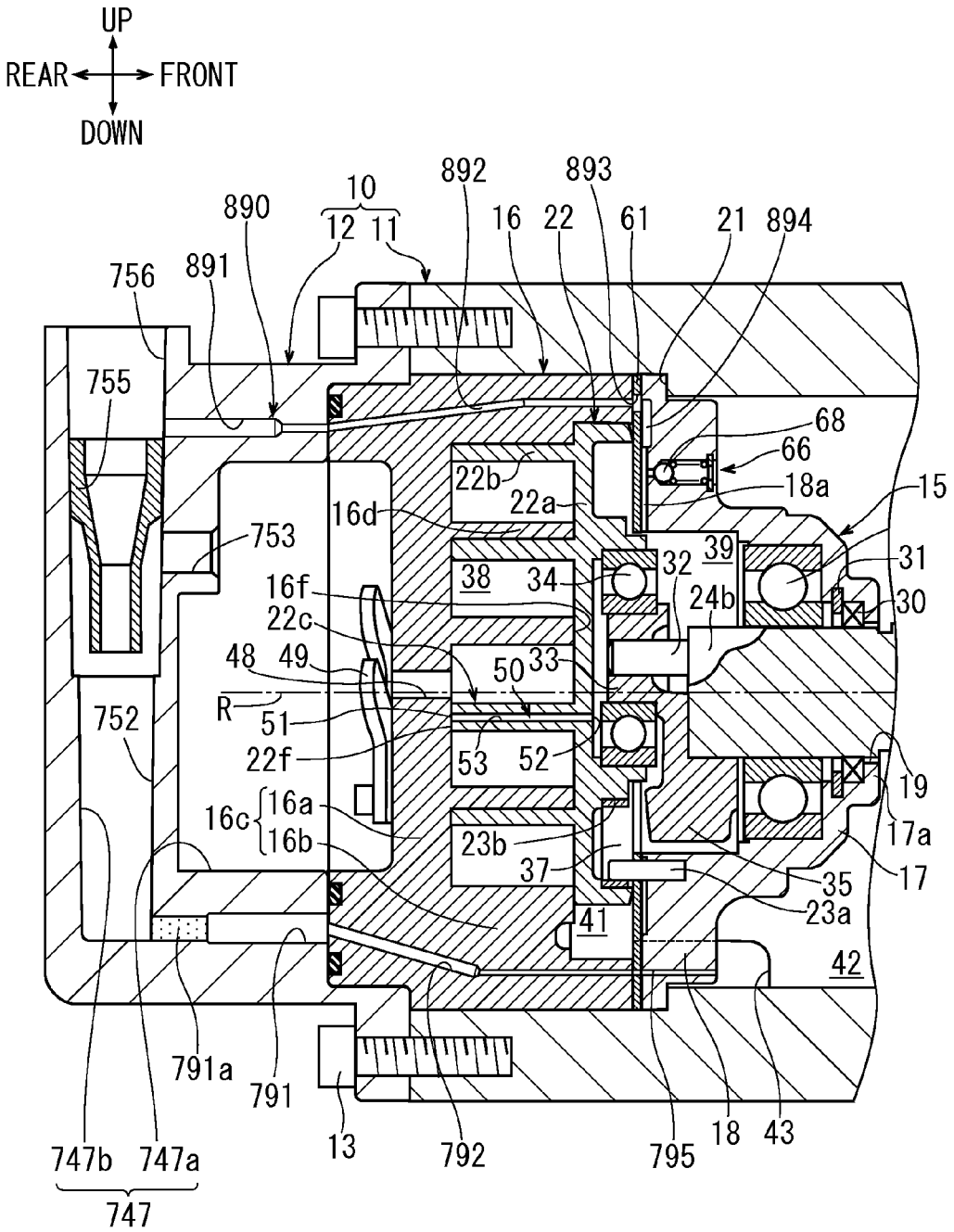
FIG. 13 is an enlarged sectional view of essential parts of a scroll compressor according to Embodiment 8.

The scroll compressor of Embodiment 8 employs a secondary supply passage 890 shown in FIG. 13 instead of the secondary supply passage 790 of the scroll compressor of Embodiment 7. Other elements are configured similarly to the scroll compressor of Embodiment 7, and therefore, the same elements are given the same reference numerals and description thereof will be omitted or simplified.

As shown in FIG. 13, in the scroll compressor of Embodiment 8, an upper part of the oil separation chamber 747*b* is in communication with the back pressure chamber 39 via the secondary supply passage 890. The secondary supply passage 890 is made up of a communication hole 891 formed in the rear housing 12, a communication hole 892 formed in the fixed scroll 16, a circular hole 893 formed in the plate 61, and a groove 894 formed to the shaft support member 15.

The communication hole 891 is a hole that communicates the front face side of the rear housing 12 with the oil separation chamber 747*b* above the oil separator 755. The communication hole 892 is a long, narrow hole extending through the outer circumferential wall 16*b* on the upper side of the fixed scroll 16 in a front to back direction. The circular hole 893 is a small-diameter hole penetrating through the outer circumferential side of the plate 61 interposed between the shaft support member 15 and the movable scroll 22. The groove 894 is a thin groove concavely formed radially outward from the annular recess 18*a* on the outer circumferential side on the rear face of the shaft support member 15.

One secondary supply passage 890 is thus formed by the communication hole 891, the communication hole 892, the circular hole 893, and the groove 894 which are communicated with one another in this order from the part of the oil separation chamber 747*b* above the oil separator 755 as the upstream side.

A communication hole 795 extending through the plate 61 and the shaft support member 15 in the front to back direction is formed in place of the slit 793 that is a part of the secondary supply passage 790 in Embodiment 7. The communication hole 791, the communication hole 792, and the communication hole 795 which are communicated with one another in this order form a lubricating oil return passage. Thus the lubricating oil accumulated at the bottom of the oil separation chamber 747*b* is returned little by little to the suction chamber 42 through this lubricating oil return passage.

With the scroll compressor of Embodiment 8 with this structure, the same actions and effects as those of the scroll compressor 1 of Embodiment 1 can be achieved.

In this scroll compressor, the refrigerant gas from which the lubricating oil has been separated by the oil separator 755 is supplied in a small amount constantly to the back pressure chamber 39 through the secondary supply passage 890. Therefore, as compared to the scroll compressor of Embodiment 1, the back pressure inside the back pressure chamber 39 is unlikely to drop. Accordingly, similarly to the scroll compressor of Embodiment 7, the refrigerant gas inside the compression chamber 38 needs to be supplied less frequently to the back pressure chamber 39 through the supply passage 50. As a result, this scroll compressor improves compression performance over the entire rpm range as compared to the scroll compressor 1 of Embodiment 1, and in particular, improves the compression performance remarkably in a low rpm range where the above-mentioned leak can largely affect the compression performance due to the low discharge volume.

Moreover, in this scroll compressor, the refrigerant gas from which the lubricating oil has been separated is supplied to the back pressure chamber 39 through the secondary supply passage 890, so that, as compared to the scroll compressor of Embodiment 7 in which the lubricating oil with a larger flow resistance is supplied, a pressure drop in the back pressure chamber is restored swiftly.

Embodiment 9

Figure 14:
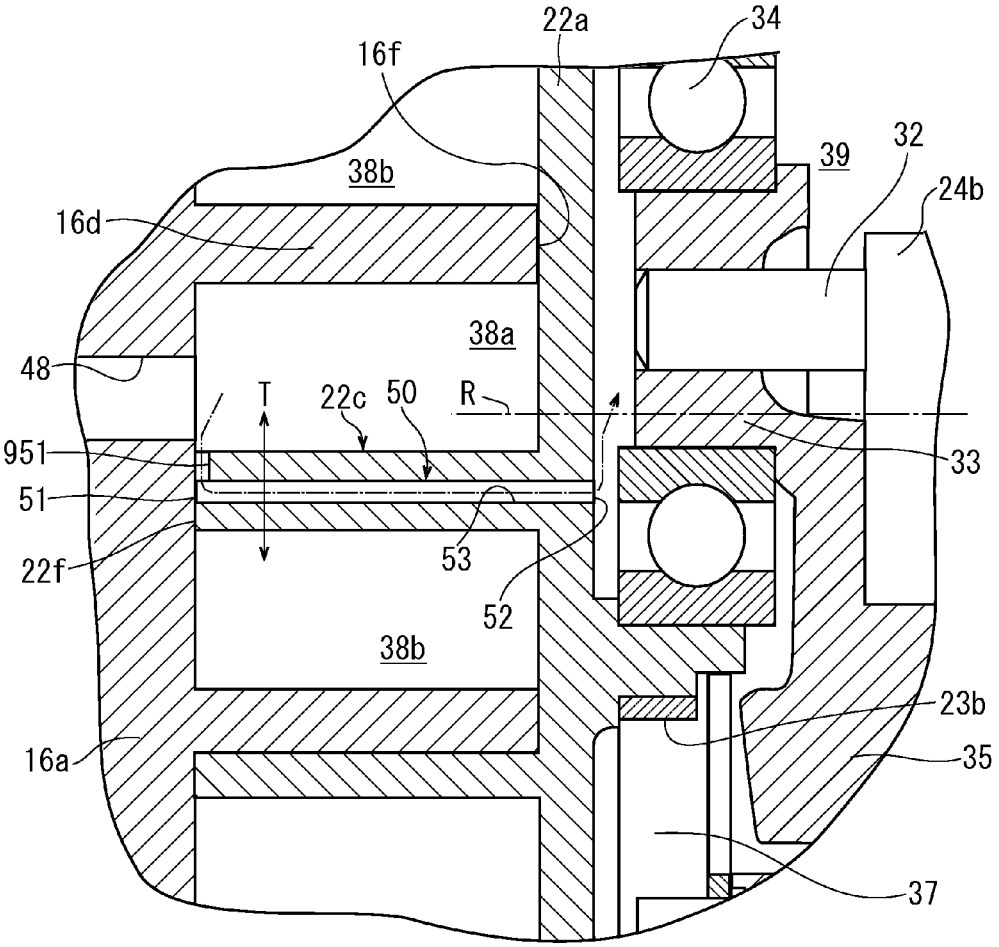
FIG. 14 is an enlarged sectional view of essential parts of a scroll compressor according to Embodiment 9.
Figure 15:
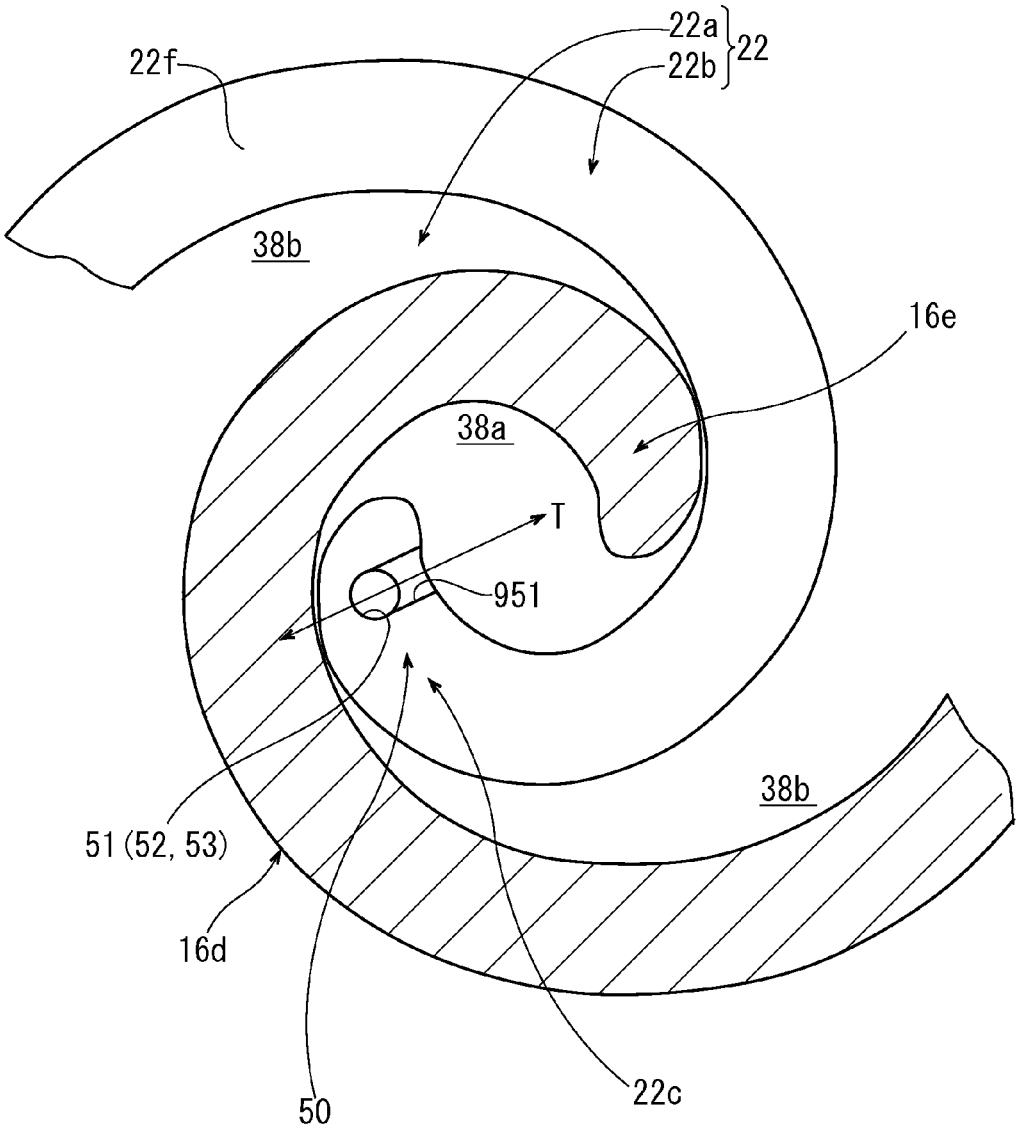
FIG. 15 is an enlarged sectional view of essential parts showing a cross section along III-III of FIG. 1 of the scroll compressor according to Embodiment 9.

The scroll compressor of Embodiment 9 includes an additional inlet notch 951 shown in FIGS. 14 and 15 in comparison to the scroll compressor of Embodiment 1. Other elements are configured similarly to the scroll compressor 1 of Embodiment 1, and therefore, the same elements are given the same reference numerals and description thereof will be omitted or simplified.

As shown in FIGS. 14 and 15, in the scroll compressor of Embodiment 9, the inlet notch 951 is concavely formed to the distal end face 22*f* of the movable spiral wrap 22*b*.

The inlet notch 951 is a groove extending from the inflow opening 51 along the thickness direction T of the movable spiral wrap 22*b* toward a direction approaching the innermost end 16*e* of the fixed spiral wrap 16*d* for providing constant communication between the inflow opening 51 and the compression chamber 38*a*. The depth and width of the inlet notch 951 is preferably determined such as to prevent easy formation of an oil seal between the inlet notch 951 and the base wall 16*a* and to throttle the refrigerant gas flowing through the inlet notch 951 to a small amount.

With the scroll compressor of Embodiment 9 with this structure, the same actions and effects as those of the scroll compressor 1 of Embodiment 1 can be achieved.

In this scroll compressor, the refrigerant gas that has been compressed to the discharge pressure inside the compression chamber 38*a* is supplied constantly in a small amount to the back pressure chamber 39 through the inlet notch 951 and the supply passage 50. Therefore, as compared to the scroll compressor of Embodiment 1, the back pressure inside the back pressure chamber 39 is unlikely to drop. As a result, this scroll compressor improves compression performance over the entire rpm range as compared to the scroll compressor 1 of Embodiment 1, and in particular, improves the compression performance remarkably in a low rpm range where the above-mentioned leak can largely affect the compression performance due to the low discharge volume.

Moreover, the inflow notch 951 can be processed more easily as compared to the process of the secondary supply passages 790 and 890 of Embodiments 7 and 8. Accordingly the production cost is reduced for this scroll compressor as compared to the scroll compressors of Embodiments 7 and 8.

Embodiment 10

Figure 16:
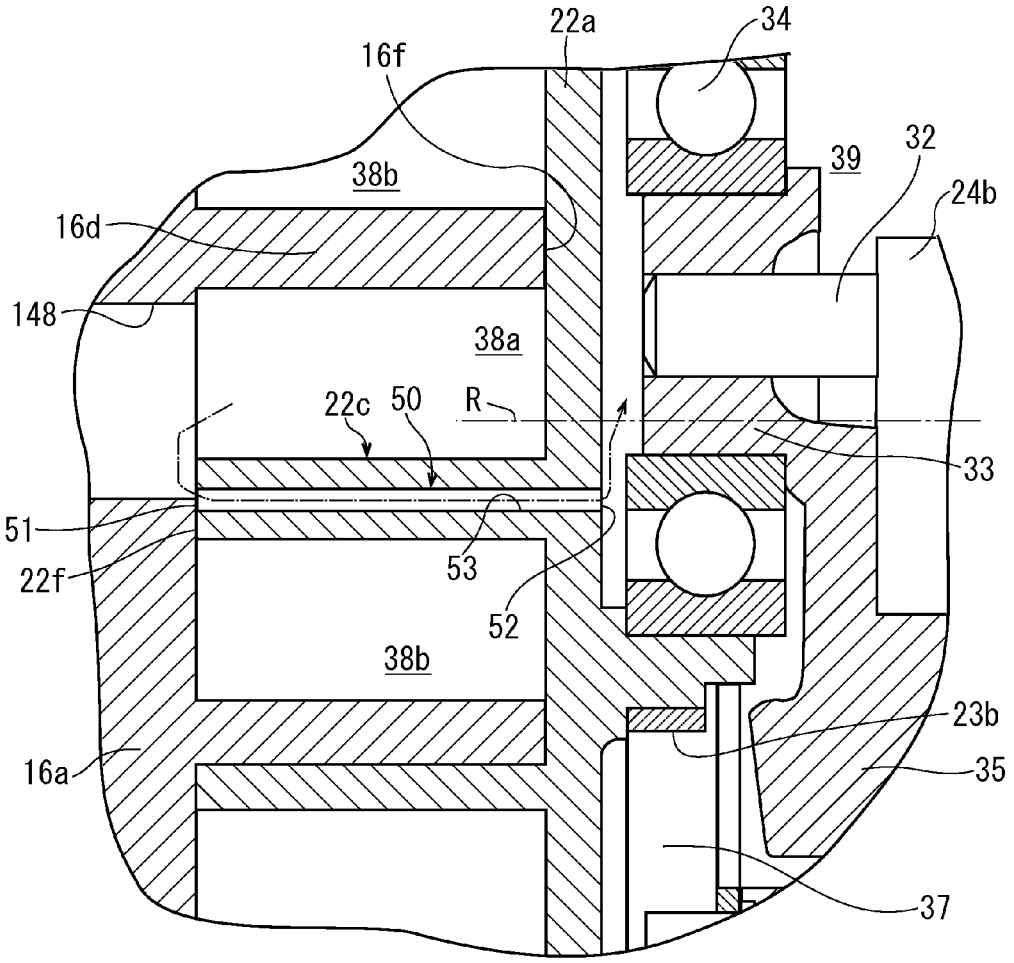
FIG. 16 is an enlarged sectional view of essential parts of a scroll compressor according to Embodiment 10.
Figure 17:
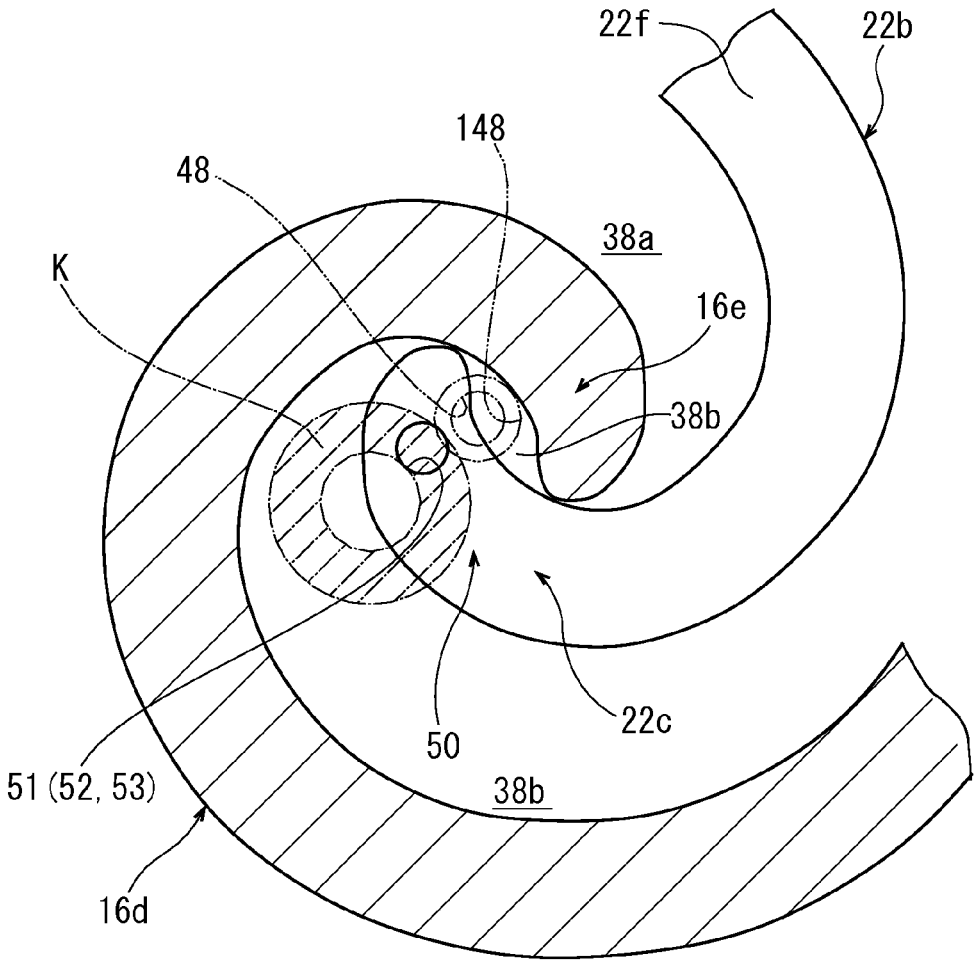
FIG. 17 is an enlarged sectional view of essential parts showing a cross section along III-III of FIG. 1 of the scroll compressor according to Embodiment 10 (illustrating the relative positional relationship between the trajectory of the inflow opening as the movable scroll orbits and the discharge port).
Figure 18:
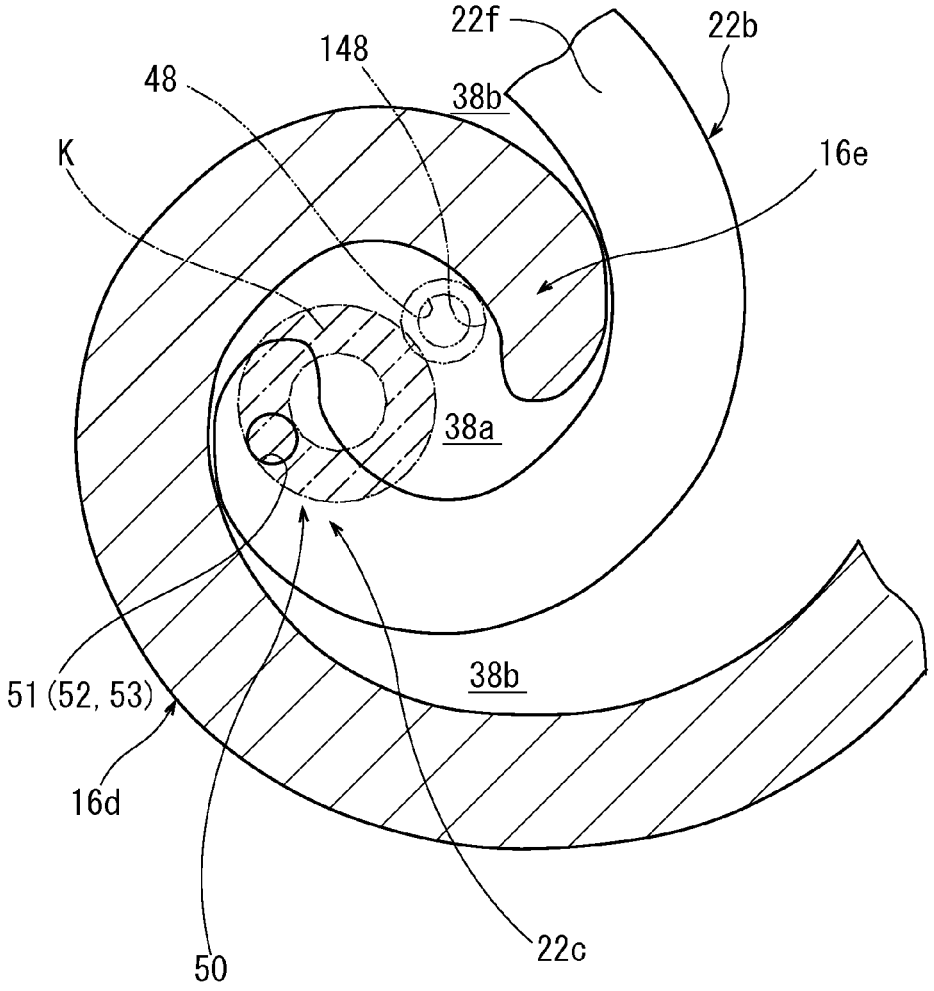
FIG. 18 is an enlarged sectional view of essential parts showing a cross section along III-III of FIG. 1 of the scroll compressor according to Embodiment 10 (illustrating the relative positional relationship between the trajectory of the inflow opening as the movable scroll orbits and the discharge port).

The scroll compressor of Embodiment 10 employs a discharge port 148 shown in FIGS. 16 to 18 instead of the discharge port 48 of the scroll compressor 1 of Embodiment 1. Other elements are configured similarly to the scroll compressor 1 of Embodiment 1, and therefore, the same elements are given the same reference numerals and description thereof will be omitted or simplified.

As shown in FIG. 16, in the scroll compressor of Embodiment 10, the discharge port 148 is formed through the center of the base wall 16*a* of the fixed base plate 16*c* so that the compression chamber 38 and the discharge chamber 47 communicate with each other through the discharge port 148. FIG. 16 shows a state in which the eccentric pin 32 is located at its uppermost position relative to the center axis line R of the rotating shaft 24. In this state, as shown in FIG. 17, the innermost end 22*c* of the movable spiral wrap 22*b* is positioned closest to the innermost end 16*e* of the fixed spiral wrap 16*d* so that the compression chamber 38*a* has a minimum volume.

The movable scroll 22 orbits as the eccentric pin 32 rotates around the center axis line R. With this orbital motion, the innermost end 22*c* of the movable spiral wrap 22*b* repeats periodic approach to and separation from the innermost end 16*e* of the fixed spiral wrap 16*d* as it traces a circular locus. For example, when the eccentric pin 32 is located at its lowermost position relative to the center axis line R, the innermost end 22*c* of the movable spiral wrap 22*b* is separated farthest from the innermost end 16*e* of the fixed spiral wrap 16*d* as shown in FIG. 18. A trajectory K traced by the inflow opening 51 when the movable scroll 22 orbits forms an annular region as shown in FIGS. 17 and 18.

The discharge port 148 is positioned above the paper plane of the sectional views of FIGS. 17 and 18. Therefore, the discharge port 148 is illustrated with a two dot chain line in FIGS. 17 and 18 to explain the relative positional relationship between the discharge port 148 and the trajectory K of the inflow opening 51. The discharge port 48 of Embodiment 1 is also indicated with a two dot chain line in FIGS. 17 and 18 so as to compare the discharge port 148 with the discharge port 48.

As shown in FIGS. 17 and 18, the discharge port 48 of Embodiment 1, generally, has a larger inside diameter than the compression chamber 38*a* with the minimum volume (Note, the discharge port 48 is illustrated with a smaller inside diameter than its actual diameter in FIG. 1 and other figures for ease of explanation). However, even with such an inside diameter, if the discharge port 48 is drilled at a normal position, it does not overlap the trajectory K of the inflow opening 51.

On the other hand, the diameter of the discharge port 48 is increased in Embodiment 10, so that the discharge port 148 provided here overlaps part of the orbit K of the inflow opening 51. FIG. 17 shows a state where the discharge port 148 is overlapping the inflow opening 51. In this state, the compression chamber 38*a* and the inflow opening 51 communicate with each other through the discharge port 148. FIG. 18 on the other hand shows a state where the discharge port 148 is not overlapping the inflow opening 51. In this state, the compression chamber 38*a* and the inflow opening 51 are not communicating with each other through the discharge port 148.

With the scroll compressor of Embodiment 10 with this structure, the same actions and effects as those of the scroll compressor 1 of Embodiment 1 can be achieved.

In this scroll compressor, the inflow opening 51 and the discharge port 148 periodically communicate with each other as the movable scroll 22 orbits. Therefore, the refrigerant gas that has been compressed to the discharge pressure inside the compression chamber 38*a* is periodically supplied to the back pressure chamber 39 through the discharge port 148 and the supply passage 50, so that the back pressure inside the back pressure chamber 39 is unlikely to drop. As a result, this scroll compressor improves compression performance over the entire rpm range as compared to the scroll compressor 1 of Embodiment 1, and in particular, improves the compression performance remarkably in a low rpm range where the above-mentioned leak can largely affect the compression performance due to the low discharge volume.

Figure 19:
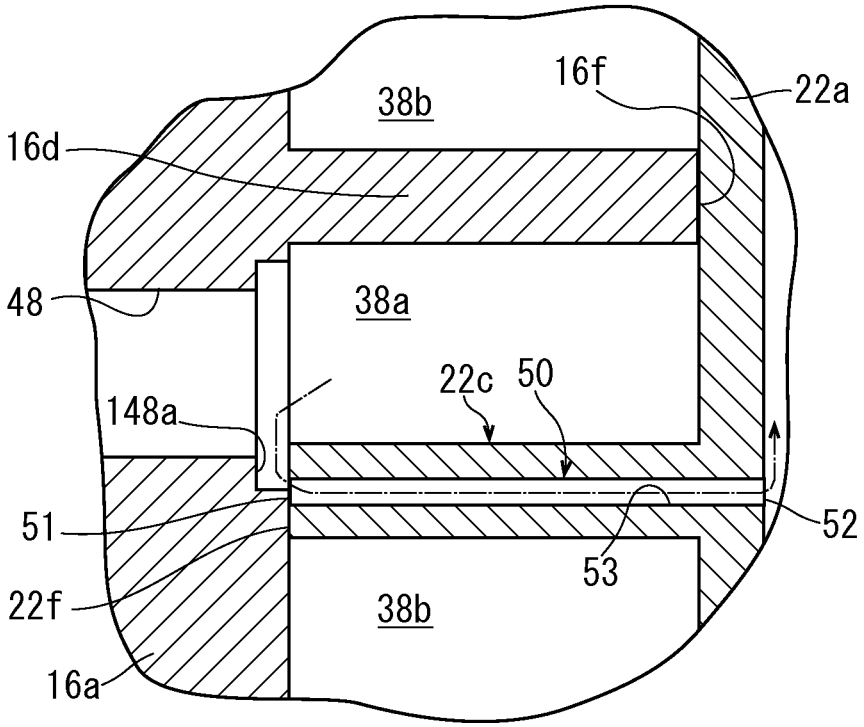
FIG. 19 is an enlarged sectional view of essential parts showing a modified example of the scroll compressor according to Embodiment 10.
Figure 20:
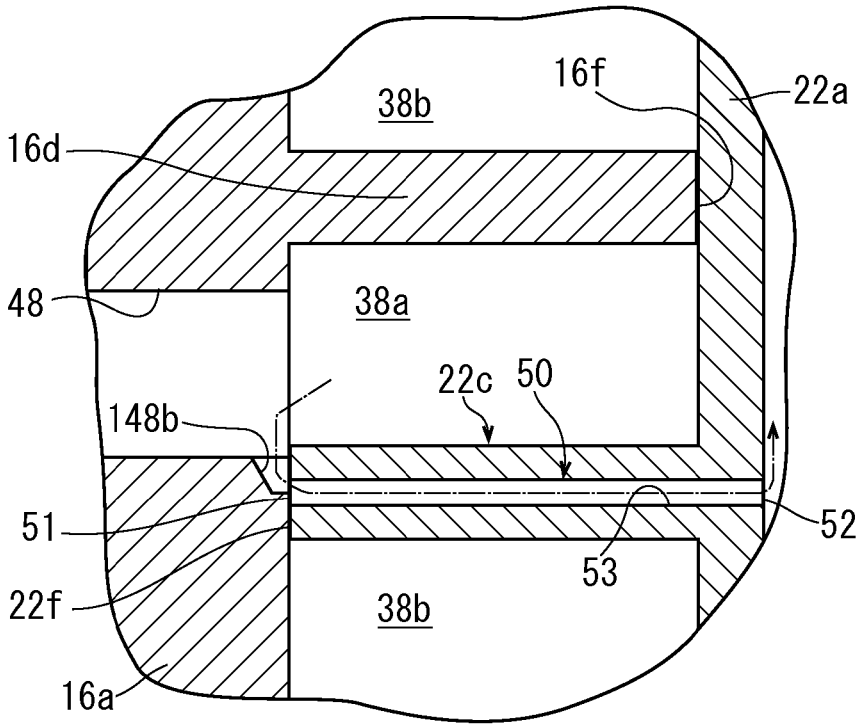
FIG. 20 is an enlarged sectional view of essential parts showing a modified example of the scroll compressor according to Embodiment 10.

Moreover, the discharge port 148 is processed only by increasing the diameter of the discharge port 48 of Embodiment 1. Alternatively, a spot face 148*a* may be additionally cut to the discharge port 48 as shown in FIG. 19, or a cutout groove 148*b* extending toward the inflow opening 51 and overlapping part of its trajectory K may be additionally processed to the discharge port 48 as shown in FIG. 20, or the discharge port 48 itself may be located to a position where it overlaps part of the trajectory K of the inflow opening 51, although not shown. Such processing is easier as compared to the process of the secondary supply passages 790 and 890 of Embodiments 7 and 8. Accordingly the production cost is reduced for this scroll compressor as compared to the scroll compressors of Embodiments 7 and 8.

While the present invention has been described above with respect to Embodiments 1 to 10, it should be appreciated that the invention is not limited to the foregoing Embodiments 1 to 10 but can be suitably changed without departing from the scope of its subject matter.

For example, an elastic sealing member such as a PTFE tip seal or the like may be provided to the distal end face 16*f* of the fixed spiral wrap 16*d* to provide a seal between the movable base plate 22*a* and the distal end face 16*f*. Or, for example, an elastic sealing member such as a PTFE tip seal or the like may be provided to the distal end face 22*f* of the movable spiral wrap 22*b* except for the vicinity of the inflow opening 51 to provide a seal between the fixed base plate 16*c* and the distal end face 22*f*.

A bulged portion similar to the bulged portion 22*g* for the outflow opening 652 in Embodiment 6 may be provided near the inflow opening 251 or 351, or outflow opening 452 of the movable spiral wrap 22*b* such as to bulge out in the thickness direction T of the movable spiral wrap 22*b*.

INDUSTRIAL APPLICABILITY

The present invention is applicable to scroll compressors.

DESCRIPTION OF REFERENCE NUMERALS

10: housing (11: front housing, 12: rear housing)
47: discharge chamber
16: fixed scroll
38, 38*a*, 38*b*: compression chamber
22: movable scroll
39: back pressure chamber
42: suction chamber
15: shaft support member
1: scroll compressor
16*c*: fixed base plate
16*d*: fixed spiral wrap
22*a*: movable base plate
22*b*: movable spiral wrap
22*f*: distal end face of movable spiral wrap
51, 251, 351: inflow opening
52, 452, 652: outflow opening
53: communication hole
50: supply passage
22*c*: innermost end of movable spiral wrap
16*e*: innermost end of fixed spiral wrap
790, 890: secondary supply passage
755: oil separator
951: inlet notch
48, 148: discharge port
R: orbit axis (center axis line of rotating shaft)
T: thickness direction of movable spiral wrap
K: Trajectory of inflow opening when the movable scroll orbits

The invention claimed is:

1. A scroll compressor comprising:

a housing;

a fixed scroll fixed inside the housing and forming a discharge chamber between the fixed scroll and the housing;

a movable scroll supported inside the housing so as to orbit only around an orbit axis and forming compression chamber between the movable scroll and the fixed scroll, the movable scroll supported by a bush that is rotatable around the orbit axis via a radial bearing;

a shaft support member fixed inside the housing and forming a back pressure chamber between the shaft support member and the movable scroll as well as a suction chamber between the shaft support member and the housing;

the fixed scroll includes a fixed base plate and a fixed spiral wrap integral with the fixed base plate;

the movable scroll includes a movable base plate facing to the fixed base plate and a movable spiral wrap integral with the movable base plate and meshing with the fixed spiral wrap; and the movable scroll is formed with a supply passage configured to communicate the compression chamber with the back pressure chamber by an elastic deformation or displacement in a direction of the orbit axis of the movable scroll, the supply passage including:

an inflow opening opened to a distal end face of the movable spiral wrap and communicatable with the compression chamber, an outflow opening formed in the movable base plate to communicate with an area surrounded by the radial bearing within the back pressure chamber at a position facing the rear end of a rotating shaft, and a communication hole communicating the inflow opening with the outflow opening, wherein the communication hole extends straight from the inflow opening to the outflow opening in the direction of the orbit axis through the movable spiral wrap and the movable base plate.

2. The scroll compressor according to claim 1, wherein the inflow opening is opened to the distal end face at an innermost end of the movable spiral wrap.

3. The scroll compressor according to claim 2, wherein the inflow opening is opened to a central portion on the distal end face of the innermost end.

4. The scroll compressor according to claim 3, wherein the inflow opening, the communication hole, and the outflow opening are aligned along the orbit axis direction.

5. The scroll compressor according to claim 3, wherein the inflow opening is offset toward an innermost end of the fixed spiral wrap in a thickness direction of the movable spiral wrap.

6. The scroll compressor according to claim 5, wherein the inflow opening is in an oval shape having a short side along the thickness direction of the movable spiral wrap.

7. The scroll compressor according to claim 1, wherein the distal end face of the movable spiral wrap is in direct sliding contact with the fixed base plate.

8. The scroll compressor according to claim 1, wherein the inflow opening is formed by spot-facing the communication hole on the side of the fixed base plate.

9. The scroll compressor according to claim 1, wherein the outflow opening is formed by spot-facing the communication hole on the side of the back pressure chamber.

10. The scroll compressor according to claim 1, wherein the discharge chamber and the back pressure chamber communicate with each other through a secondary supply passage.

11. The scroll compressor according to claim 10, wherein an oil separator for separating the refrigerant gas and the lubricating oil from each other is provided inside the discharge chamber; and wherein the secondary supply passage supplies the lubricating oil separated from the refrigerant gas inside the discharge chamber to the back pressure chamber.

12. The scroll compressor according to claim 10, wherein an oil separator for separating the refrigerant gas and the lubricating oil from each other is provided inside the discharge chamber; and wherein the secondary supply passage supplies the refrigerant gas separated from the lubricating oil inside the discharge chamber to the back pressure chamber.

13. The scroll compressor according to claim 1, wherein the distal end face of the movable spiral wrap is concavely formed with an inlet notch for constantly communicating the inflow opening and the compression chamber.

14. The scroll compressor according to claim 1, wherein a discharge port is drilled in the fixed base plate to communicate the compression chamber with the discharge chamber, and wherein part of a trajectory of the inflow opening when the movable scroll orbits overlaps the discharge port.

* * * * *